US006478638B2

(12) United States Patent
Matsuda et al.

(10) Patent No.: US 6,478,638 B2
(45) Date of Patent: Nov. 12, 2002

(54) JET-PROPULSION WATERCRAFT

(75) Inventors: Yoshimoto Matsuda, Kobe (JP); Keiji Takahashi, Akashi (JP)

(73) Assignee: Kawasaki Jukogyo Kabushiki Kaisha, Chuo-Ku (JP)

( * ) Notice: Subject to any disclaimer, the term of this patent is extended or adjusted under 35 U.S.C. 154(b) by 0 days.

(21) Appl. No.: 09/924,232

(22) Filed: Aug. 8, 2001

(65) Prior Publication Data

US 2002/0028613 A1 Mar. 7, 2002

(30) Foreign Application Priority Data

Aug. 8, 2000 (JP) ..... 2000-240276
Oct. 18, 2000 (JP) ..... 2000-317559

(51) Int. Cl.[7] ..... B63H 21/22; B63H 11/113
(52) U.S. Cl. ..... 440/1; 440/2; 440/42; 440/87
(58) Field of Search ..... 440/1, 2, 38, 40–43, 440/87

(56) References Cited

FOREIGN PATENT DOCUMENTS

JP P2001-191992 A 7/2001
JP P2001-354195 A 12/2001

*Primary Examiner*—Sherman Basinger
(74) *Attorney, Agent, or Firm*—Marshall, Gerstein & Borun

(57) ABSTRACT

A jet-propulsion watercraft can maintain steering capability even during throttle-close operation as the amount of water ejected from a water jet pump is thereby reduced. Engine speed is increased by a push-pull cable provided between a rotational shaft of a steering handle and a throttle lever. The throttle lever is forced to rotate which opens a throttle valve according to the amount of steering. Alternatively, the engine speed is increased by increasing a fuel of an auxiliary air-fuel mixture supplying system provided independently of a main air-fuel mixture supplying system while a throttle-close operation and a steering handle operation are detected. The auxiliary supplying system is provided in a position of an air supplying passage to the main supplying system and an air-fuel mixture supplying passage of the main supplying system directly or indirectly through a predetermined connecting passage.

31 Claims, 18 Drawing Sheets

JET-PROPULSION WATERCRAFT

BACKGROUND OF THE INVENTION

1. Field of the Invention

The present invention relates to a jet-propulsion watercraft which ejects water rearward and planes on a water surface as the resulting reaction. More particularly, the present invention relates to a jet-propulsion watercraft that can maintain steering capability even when the throttle is operated in the closed position and propulsion force is thereby reduced.

2. Description of the Related Art

In recent years, so-called jet-propulsion personal watercraft (PWC) have been widely used in leisure, sport, rescue activities, and the like. The personal watercraft is configured to have a water jet pump that pressurizes and accelerates water sucked from a water intake generally provided on a bottom of a hull and ejects it rearward from an outlet port. Thereby, the personal watercraft is propelled.

In the personal watercraft, in association with a steering handle of a general bar type, a steering nozzle provided behind the outlet port of the water jet pump is swung either to the right or left, to change the ejecting direction of the water to the right or to the left, thereby turning the watercraft to the right or to the left.

A deflector is retractably provided behind the steering nozzle for blocking the water ejected from the steering nozzle. The deflector is moved downward to deflect the ejected water forward, and as the resulting reaction, the personal watercraft moves rearward. In some watercraft, in order to move rearward, a water flow is formed so as to flow from an opening provided laterally of the deflector along a transom board to reduce the water pressure in an area behind the watercraft.

In the above-described personal watercraft, when the throttle is moved to a substantially fully closed position and the water ejected from the water jet pump is thereby reduced, during forward movement and rearward movement, the propulsion force necessary for turning the watercraft is correspondingly reduced, and the steering capability of the watercraft is therefore reduced until the throttle is re-opened.

To address the above-described condition with a mechanical structure, the applicant disclosed a jet-propulsion personal watercraft comprising a steering component for an auxiliary steering system which operates in association with the steering handle in addition to a steering nozzle for the main steering system in Japanese Patent Application No. Hei. 2000-6708.

Also, for the purpose of achieving a lightweight watercraft, the applicant disclosed a jet-propulsion personal watercraft in Japanese Patent Application No. Hei. 2000-173232, in which a sensor is adapted to detect a throttle-close operation, a steering operation, or the like, and an engine speed is increased according to the detection.

SUMMARY OF THE INVENTION

The present invention addresses the above-described condition, and an object of the present invention is to provide a jet-propulsion watercraft that can maintain steering capability according to the cruising speed thereof even while an operation which closes the throttle (hereinafter referred to as "throttle-close operation") is performed and the amount of water ejected from a water jet pump is thereby reduced.

According to the present invention, there is provided a jet-propulsion watercraft comprising: a water jet pump that pressurizes and accelerates sucked water and ejects the water from an outlet port provided behind the water jet pump to propel the watercraft as a reaction of the ejecting water; an engine for driving the water jet pump, the engine being provided with a throttle valve; a steering operation means that operates in association with a steering nozzle of the water jet pump; a throttle lever for being operated to open/close the throttle valve; a first connecting member for connecting the throttle lever to the throttle valve; and a second connecting member for connecting the steering operation means or a rotational shaft of the steering operation means to the throttle lever so as to operate the throttle lever to cause the throttle valve to be opened according to an steering operation of the steering operation means.

In a jet-propulsion watercraft of the present invention, even while the throttle-close operation is performed but the steering operation means is operated, the second connecting member operates the throttle lever to a direction to open the throttle valve according to the steering amount or a rotational angle of the rotational shaft according to the steering. Since the engine speed is increased according to the amount of the throttle lever operation, the water sufficient to turn the watercraft is ejected from the water jet pump, that is, a sufficient propulsion force is thereby obtained. Consequently, the steering capability can be maintained even while the throttle-close operation is performed.

Herein, control for increasing the engine speed is referred to as "steering assist mode control", and the "throttle-close operation" is to be understood to signify an operation performed to bring the throttle toward a closed position by a predetermined amount or more.

The second connecting member may be constituted by a push-pull cable. One end portion of the cable is connected to a portion protruded directly or indirectly on an outer peripheral face of the rotational shaft of the steering handle. Since the one end portion of the push-pull cable is thus connected to the portion protruded on the outer peripheral face of the rotational shaft, the rotational angle of the rotational shaft according to the steering operation can be converted into the movement of the cable at a greater rate. Also, since advancement/retraction of the other end portion of the operated cable operates the throttle lever to cause the throttle to be opened, the second connecting member can be constituted by a simple general member.

As the second connecting member described above, a pair of push-pull cables are provided. These cables are pushed and pulled toward opposite directions with respect to each other according to the rotation of the rotational shaft. One of the other end portions of these cables, i.e., the end portions of the cables connected to the throttle lever, is advanced/retracted to operate the throttle lever to cause the throttle to be opened. When the steering operation means is steered to the right or to the left, the throttle lever can be operated to cause the throttle to be opened regardless of the steering direction.

According to the present invention, there is also provided a jet-propulsion watercraft comprising: a water jet pump that pressurizes and accelerates sucked water and ejects the water from an outlet port provided behind the water jet pump to propel the watercraft as a reaction of the ejecting water; an engine for driving the water jet pump; a steering operation means that operates in association with a steering nozzle of the water jet pump; a first air-fuel mixture supplying system for supplying an air-fuel mixture to the engine through a first air-fuel mixture supplying passage, the first air-fuel mixture supplying system being provided with a first throttle valve; a second air-fuel mixture supplying system for supplying an air-fuel mixture to the engine through a second air-fuel mixture supplying passage; and a throttle lever for performing an open/close operation of the first throttle valve, and the second air-fuel mixture supplying system is adapted to increase the air-fuel mixture supplied to the engine during the operation of the steering operation means, thereby increasing the engine speed.

According to the jet-propulsion watercraft of the present invention, while the throttle-close operation is performed, and thereby the air-fuel mixture is not supplied from the first air-fuel mixture supplying system generally provided in the engine, the air-fuel mixture is supplied to the engine from the second air-fuel mixture supplying system while the steering operation means is operated. Thereby, the engine speed is increased. Therefore, the water sufficient to turn the watercraft is ejected from the water jet pump, that is, a sufficient propulsion force is obtained. Consequently, steering capability can be maintained even while the throttle-close operation is performed.

Specifically, the fuel-air mixture is supplied from the second air-fuel mixture supplying system as follows. The watercraft comprises a first connecting member for connecting the throttle lever to the first throttle valve; and a second connecting member for connecting the steering operation means or a rotational shaft of the steering operation means to the second throttle valve, to cause the second throttle valve to be opened according to an steering operation of the steering operation means. In this case, according to the steering amount or the rotational angle of the rotational shaft according to the steering, the second connecting member causes the throttle valve of the second air-fuel mixture supplying system to be opened. With this configuration, the air-fuel mixture supply can be increased according to the position of the throttle valve.

The second air-fuel mixture supplying system may be provided at a position in the air supplying passage to the first air-fuel mixture supplying system and in the first air-fuel mixture supplying passage. In this case, the second air-fuel mixture supplying system may be connected to the position directly or indirectly through a connecting passage. When the second air-fuel mixture supplying system is indirectly connected, the degree of freedom at which the system can be mounted is increased and the mounting space for the whole engine including the system can be reduced.

Also, the first air-fuel mixture supplying passage may be provided with a passage that bypasses the throttle valve in the first air-fuel mixture supplying system, and the second air-fuel mixture supplying system can be provided in this bypass passage.

The second air-fuel mixture supplying system may be provided on the side of the first air-fuel mixture supplying system with respect to the engine. Thereby, the predetermined connecting passage connecting the second air-fuel mixture supplying system and the first air-fuel mixture supplying passage can be shortened. Consequently, since the fuel-air mixture is quickly supplied into the engine from the second air-fuel mixture supplying system, the response of the engine to the air-fuel mixture supply from the second air-fuel mixture supplying system can be improved.

A check valve may be provided in a fuel supplying passage for supplying fuel to the second air-fuel mixture supplying system from a fuel supplying source, to flow the fuel only toward the second air-fuel mixture supplying system from the fuel supplying source. Thereby, back flow of the fuel due to the vibration of the engine or the like can be prevented and the air-fuel mixture can be stably supplied from the second air-fuel mixture supplying system to the engine.

A liquid entry prevention means may be provided at a supply source side end of the air supplying passage of the second air-fuel mixture supplying system, for preventing liquid (i.e., water) from being mixed into a supplying air. Since the entry of the water into the engine is prevented, the engine can stably operate. The liquid entry prevention means may be, for example, an air-intake box (or air cleaner box) provided in the first air-fuel mixture supplying system. In this case, since there is no need for an additional member mounted on the watercraft as the liquid entry prevention means, a lightweight watercraft can be achieved.

The first air-fuel mixture supplying system and the second air-fuel mixture supplying system may comprise a common fuel supply source. Thereby, the lightweight watercraft can be also achieved.

The first air-fuel mixture supplying system and the second air-fuel mixture supplying system may be located at substantially the same position in the vertical direction of the watercraft. Thereby, for example, when a common pressure regulator is employed to supply the fuel to both air-fuel mixture supplying systems, the pressures at which the fuel is supplied to these air-fuel mixture supplying systems become equal. Consequently, the air-fuel mixture can be stably supplied to the engine from these air-fuel mixture supplying systems.

The second air-fuel mixture supplying system is mounted to a position of the watercraft that is within a vibration system independent of a vibration system of the engine. Thereby, the second air-fuel mixture supplying system is not directly subjected to the vibration of the engine, and therefore, the air-fuel mixture can be stably supplied to the engine from the second air-fuel mixture supplying system.

When the engine is a multiple-cylinder engine, the air-fuel supplying passage of the second air-fuel mixture supplying system may be branched according to the number of cylinders, and the air-fuel mixture is supplied to the respective cylinders through the branched air-fuel mixture supplying passages (this may be including the predetermined connecting passages). Thereby, the similar state (e.g., density or atomized state) air-fuel mixture can be easily supplied to the plurality of cylinders. Also, since the air-fuel mixture can be supplied to the plurality of cylinders by using the single second air-fuel mixture supplying system, the lightweight watercraft can be achieved.

The lengths of the branched connecting passages are set substantially equal. Thereby, the uniform air-fuel mixture can be easily supplied to the respective cylinders.

The fuel-air mixture may be also supplied from the second air-fuel mixture supplying system as follows. The watercraft may further comprise: a steering position sensor for detecting a predetermined steering position of the steering operation means; and an electric control unit, and the electric control unit is adapted to execute control to increase the air-fuel mixture being supplied to the engine from the second air-fuel mixture supplying system, for example, by executing control to open the throttle valve of the second air-fuel mixture supplying system, while the steering position sensor is detecting a predetermined steering position.

The steering position sensor may be constituted by a proximity switch provided to a rotational shaft of the steering operation means.

The throttle valve of the second air-fuel mixture supplying system is opened by supplying electric power to a solenoid adapted to drive the throttle valve to be opened/closed, by the control of the electric control unit. Thereby, the second air-fuel mixture supplying system can be electrically controlled.

The personal watercraft may further comprise a throttle-close operation detecting means for detecting a close-operation of the throttle valve in the first air-fuel mixture supplying system, and the engine speed can be increased while the steering operation is detected by the steering position sensor and the throttle-close operation is detected by the throttle-close operation detecting means.

The throttle-close operation may be detected by the throttle position sensor or the engine speed sensor and the throttle position sensor. The throttle-close operation detecting means is not limited to these and may be a detecting means provided in a mechanism connecting the throttle lever to the throttle valve of the first air-fuel mixture supplying system, for detecting an operation of the mechanism at the throttle-close operation of the throttle valve. Also, it is possible to use a sensor for detecting an air-intake pressure and an air-intake amount of the supplying air to the engine. When the air-intake pressure is used, the relationship between the air-intake pressure and the engine speed is obtained in advance, for detecting the throttle-close operation only when the engine speed is low.

The above and further objects and features of the invention will more fully be apparent from the following detailed description of the accompanying drawings.

DETAILED DESCRIPTION OF THE PREFERRED EMBODIMENTS

Hereinafter, a jet-propulsion watercraft according to embodiments of the present invention will be described with reference to accompanying drawings. In the embodiments below, a personal watercraft will be described.

First Embodiment

Figure 1:
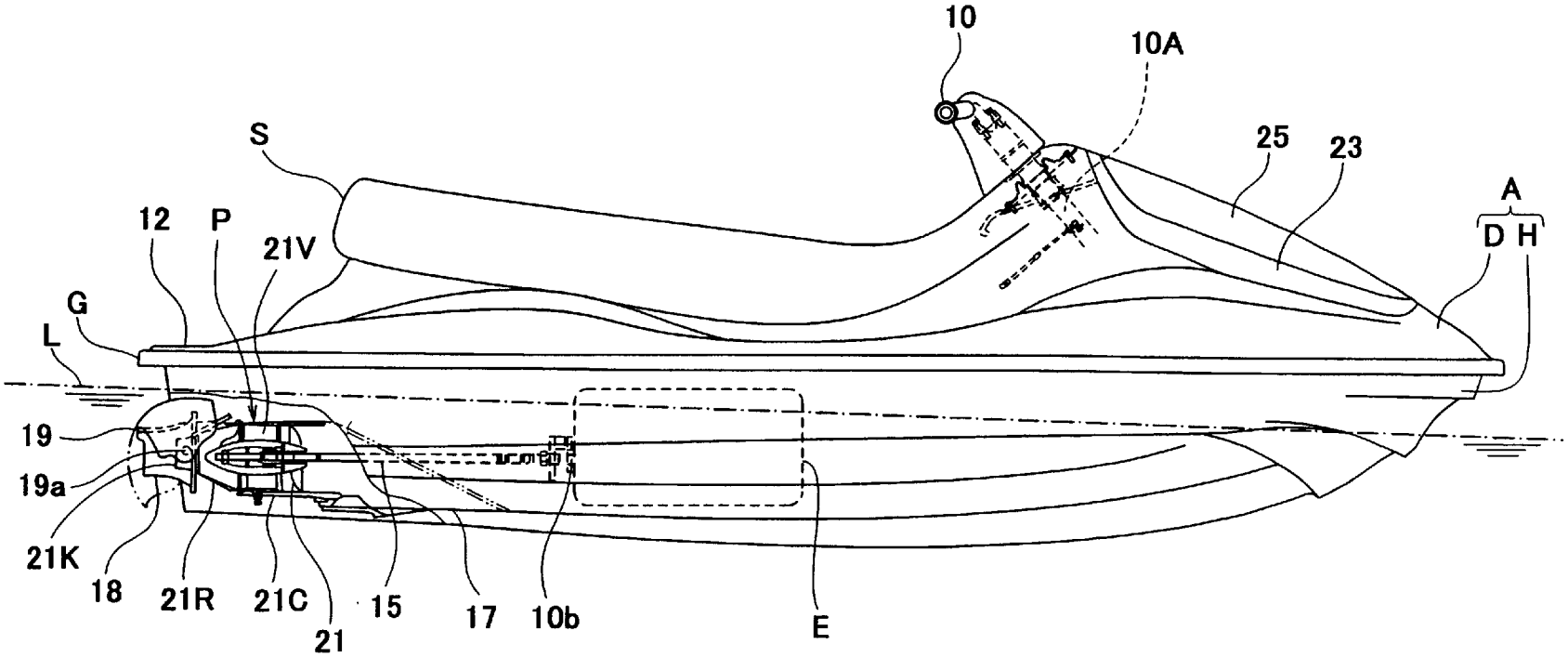
FIG. 1 is a side view showing an entire personal watercraft with a steering mechanism according to an embodiment of the present invention.
Figure 2:
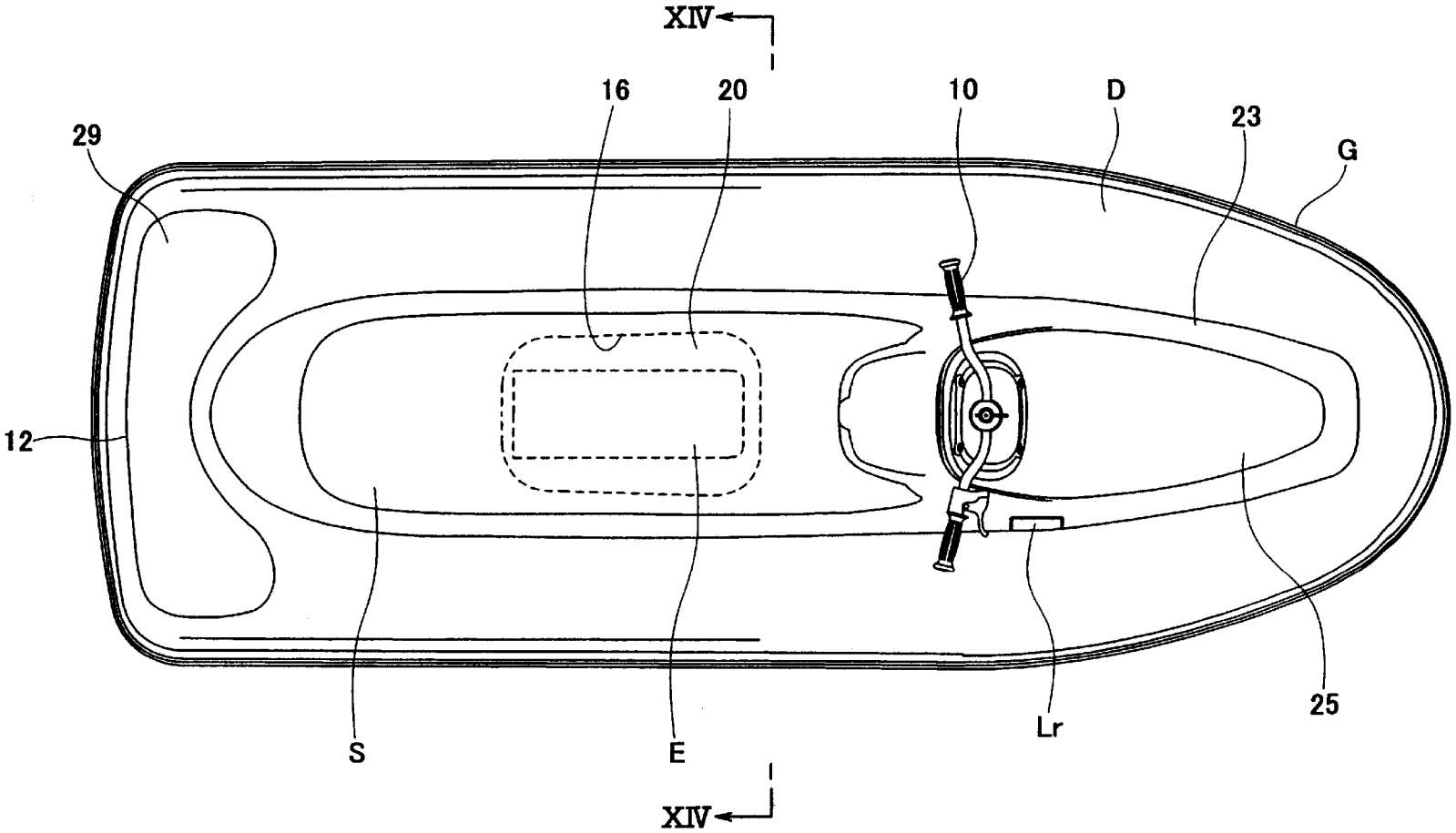
FIG. 2 is a plan view showing the entire personal watercraft of FIG. 1.

FIG. 1 is a side view showing an entire personal watercraft according to a first embodiment of the present invention and FIG. 2 is a plan view of FIG. 1. Referring now to FIGS. 1, 2, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 2, an opening 16, which has a substantially rectangular shape seen from above, is formed at a relatively rear section of the deck D such that it extends in the longitudinal direction of the body A, and a riding seat S is provided above the opening 16 such that it covers the opening 16 from above. An engine E is provided in a chamber 20 surrounded by the hull H and the deck D below the seat S.

The engine E includes multiple cylinders (e.g., three-cylinders). As shown in FIG. 1, a crankshaft 10*b* of the engine E is mounted along the longitudinal direction of the body A. An output end of the crankshaft 10*b* is rotatably coupled integrally with a pump shaft of a water jet pump P through a propeller shaft 15. An impeller 21 is mounted on the pump shaft of the water jet pump P. The impeller 21 is covered with a pump casing 21C on the outer periphery thereof.

A water intake 17 is provided on the bottom of the hull H. The water is sucked from the water intake 17 and fed to the water jet pump P through a water intake passage. The water jet pump P pressurizes and accelerates the water. The pressurized and accelerated water is discharged through a pump nozzle 21R having a cross-sectional area of flow gradually reduced rearward, and from an outlet port 21K provided on the rear end of the pump nozzle 21R, thereby obtaining propulsion force. In FIG. 1, reference numeral 21V denotes fairing vanes for fairing water flow behind the impeller 21.

As shown in FIGS. 1, 2, reference numeral 10 denotes a bar-type steering handle as a steering operation means. The handle 10 operates in association with the steering nozzle 18 provided behind the pump nozzle 21R such that the steering nozzle 18 is swingable rightward or leftward. When the rider rotates the handle 10 clockwise or counterclockwise, the steering nozzle 18 is swung toward the respective opposite direction so that the watercraft can be turned to any desired direction when the water jet pump P is generating the propulsion force.

In FIGS. 1, 2, reference numeral 12 denotes a rear deck. The rear deck 12 is provided with an openable rear hatch cover 29. A rear compartment (not shown) with a small capacity is provided under the rear hatch cover 29. Reference numeral 23 denotes a front hatch cover. A front compartment (not shown) is provided under the front hatch cover 23 for storing equipment and the like. A hatch cover 25 is provided over the front hatch cover 23, thereby forming a two-layer cover. A life jacket and the like can be stored under the hatch cover 25 through an opening (not shown) provided in the rear end thereof.

As shown in FIG. 1, a bowl-shaped reverse deflector 19 is provided above the rear side of the steering nozzle 18 such that it can swing downward around a horizontally mounted swinging shaft 19*a*.

In this embodiment, as shown in FIG. 2, a reverse switching lever Lr is provided in the vicinity of the handle 10 and at a portion of the body A that is forward of the handle 10 on the right side, for performing switching between forward movement and rearward movement of the watercraft.

Figure 3:
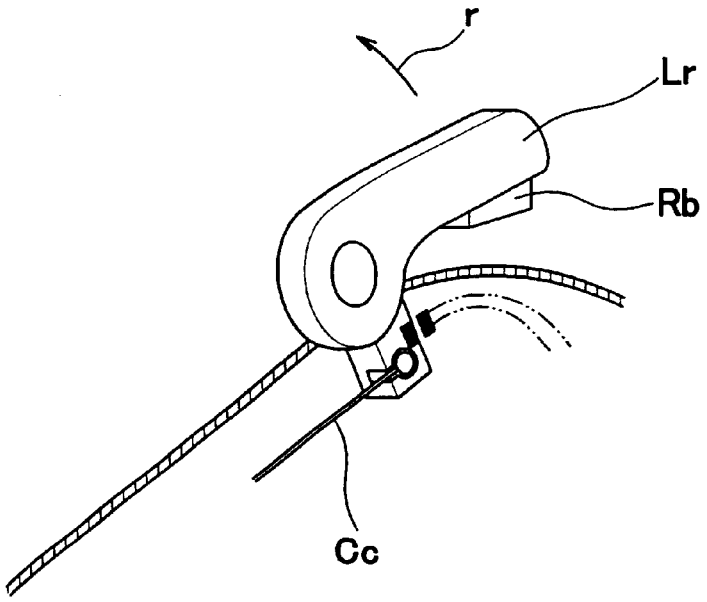
FIG. 3 is partially enlarged perspective view showing a reverse switching lever of FIG. 2.

FIG. 3 is an enlarged cross-sectional view showing the reverse switching lever Lr. As shown in FIG. 3, the reverse switching lever Lr is provided with a locking release button Rb at a tip end thereof for locking and releasing swing operation of the lever Lr. The rider presses the locking release button Rb and pivotally raises the reverse switching lever Lr as indicated by an arrow r around a swinging shaft, to pull a cable Cc connected at one end thereof to a base end of the reverse switching lever Lr. Thereby, the deflector 19 connected to the other end of the cable Cc is swung to a lower position rearward of the steering nozzle 18 and the water discharged rearward from the steering nozzle 18 is deflected forward. Thus, switching from forward movement to rearward movement is performed. In this state, upon the rider releasing the locking release button Rb, the raised position of the reverse switching lever Lr is locked and the watercraft is maintained in a rearward movement state. Then, in this state, when the rider re-presses the locking release button Rb and pivotally lowers the reverse switching lever Lr toward the opposite direction, the watercraft can move forward again.

Figure 4A:
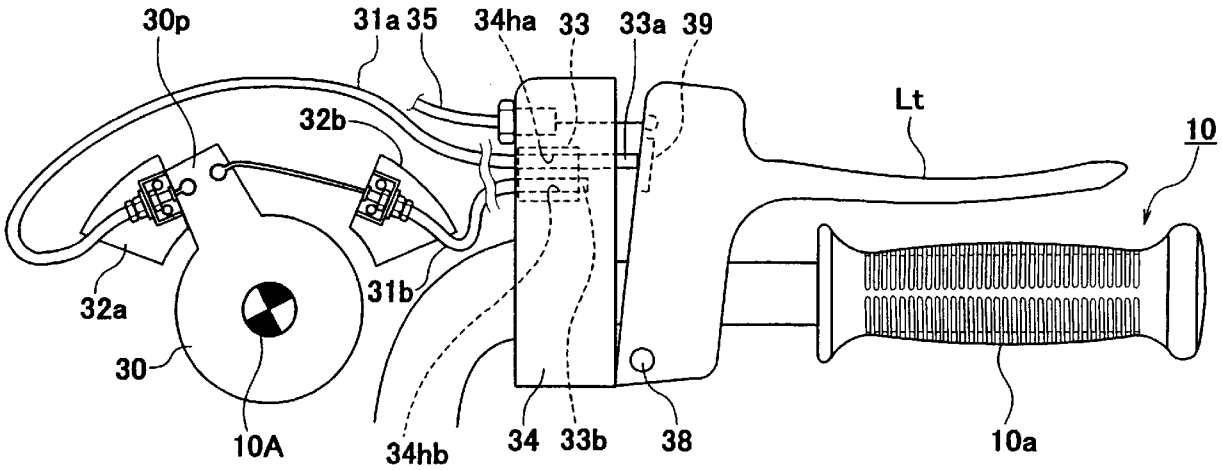
FIGS. 4A, 4B are plan views schematically showing a configuration and an operation of a throttle operation mechanism of the personal watercraft according to a first embodiment.
Figure 4B:
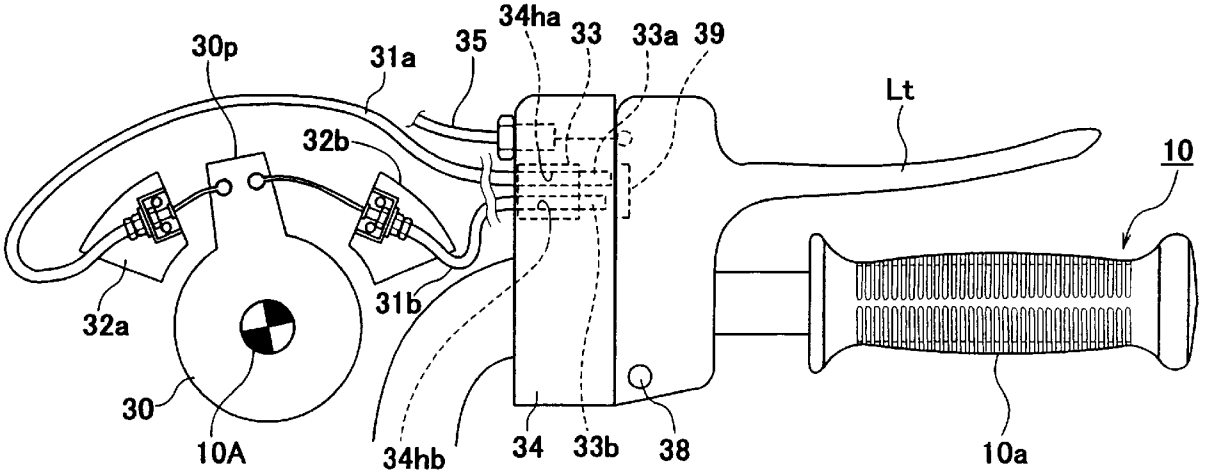

In the personal watercraft according to the first embodiment, as shown in FIGS. 4A, 4B, a throttle lever Lt is mounted by means of a support member 34 inward of a grip portion 10*a* of the handle 10 (in this embodiment, right side of the handle 10). The support member 34 is block-shaped and extended forward of the handle 10. The support member 34 is provided with a vertical shaft 38 at a rear end portion thereof on the right side. The throttle-lever Lt forward of the grip portion 10*a* is rotatably supported by the vertical shaft 38. The rider performs a grip/release operation of the throttle lever Lt to cause a throttle valve (not shown) of a carburetor mounted to the engine E connected to the throttle lever Lt via a throttle cable 35 to operate, thereby increasing/decreasing the engine speed.

Figure 5:
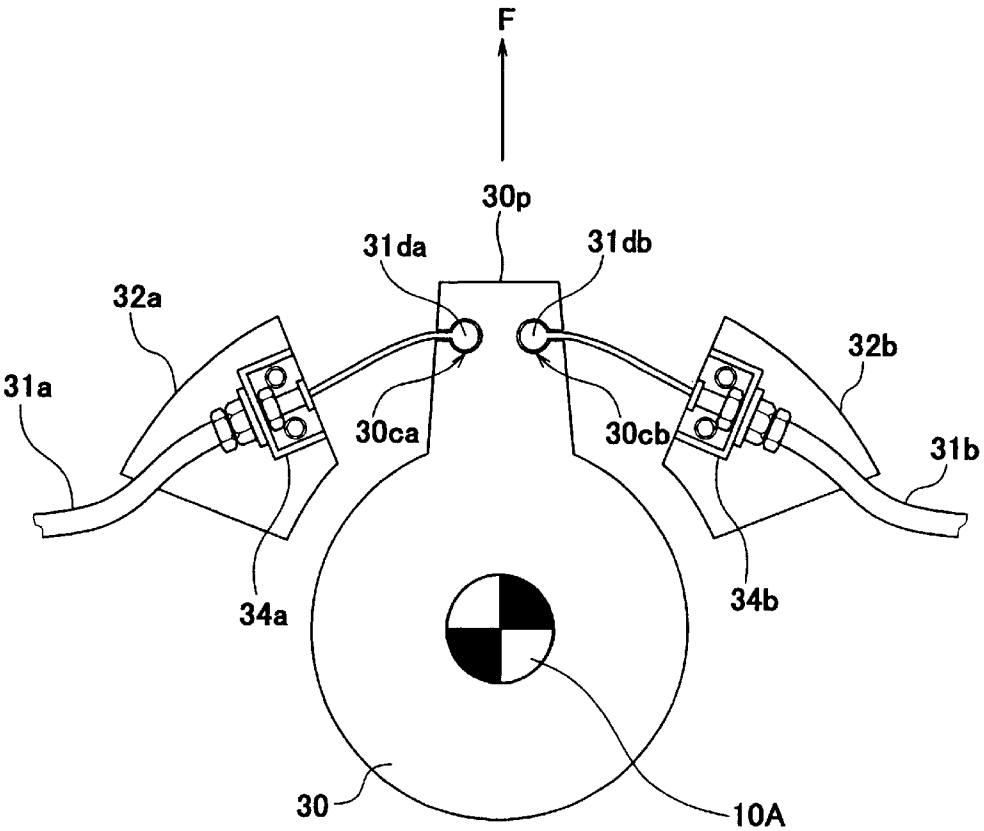
FIG. 5 is a partially enlarged view showing a structure in the vicinity of a rotational shaft of FIGS. 4A, 4B.

As shown in FIG. 5, an annular disc 30 is mounted at a position in the longitudinal direction of a rotational shaft 10A (see FIG. 1) of the handle 10. The annular disc 30 is provided with a protruded portion 30*p* extending from an outer peripheral portion of the disc. In this embodiment, the protruded portion 30*p* faces the front F of the watercraft when the handle 10 is at a neutral position. When the handle 10 is rotated, the protruded portion 30*p* is rotated along with the rotational shaft 10A and the annular disc 30.

Handle stoppers 32*a*, 32*b* are respectively provided at suitable positions on right and left sides within an operation area of the protruded portion 30P according to the steering operation. The handle stoppers 32*a*, 32*b* serve to restrict the largest steering angles of the handle 10. In this embodiment, the largest steering angles on the right and left sides are respectively set to approximately 20 degrees. While the placement of the protruded portion 30*p* of the annular disc 30 and the handle stoppers 32*a*, 32*b* is not limited to the above, it is desirable to establish the positional relationship between them so that the handle 10 can be steered by uniform angles to the right or to the left.

A pair of push-pull cables 31*a*, 31*b*, each including an outer cable cover and an inner wire, are respectively fixed to the handle stoppers 32*a*, 32*b* by means of cable holders 34*a*, 34*b* so that one end of the outer cable covers of each of the push-pull cables 31*a*, 31*b* respectively faces toward the protruded portion 30*p* of the annular disc 30. Drum-shaped cable ends 31*da*, 31*db* named "cable drums" are provided at one end of each inner wire of cables 31*a*, 31*b*. The cable ends 31*da*, 31*db* are accommodated in concave portions 31*ca*, 31*cb* formed at the corresponding positions of the protruded portion 30*p*.

As shown in FIGS. 4A, 4B, the other end portions of the pair of push-pull cables 31*a*, 31*b* are mounted to the support member 34 of the throttle lever Lt. Specifically, a block-shaped member 33 is embedded in the support member 34. Penetrating holes 34*ha*, 34*hb* are formed laterally in the block-shaped member 33. Pins 33*a*, 33*b* are respectively inserted into the penetrating holes 34*ha*, 34*hb* such that these pins are movable in the direction in which they penetrate. The left-side end portions of these pins 33*a*, 33*b* are respectively connected to the other inner wire ends of the push-pull cables 31*a*, 31*b*.

As shown in FIG. 4A, when the handle is steered to the left, the inner wire of the push-pull cable 31*a* on the left side is pushed into the corresponding outer cable cover, while the inner wire of the push-pull cable 31*b* on the opposite side (right side) is pulled out of the corresponding outer cable cover. As a result, the pushed inner wire of the cable 31*a* pushes the pin 33*a* connected thereto so the pin 33*a* is protruded outwardly, while the pulled inner wire of the cable 31*b* pulls in the pin 33*b* connected thereto so the pin 33*b* is pulled inwardly.

The pushed and protruded pin 33*a* pushes a protector plate 39 embedded in the corresponding portion of the throttle lever Lt to cause the throttle lever Lt to be swung toward an open side. As shown in FIG. 4A, the protruded amount of the pin 33*a* is the largest when the handle 10 is steered so as to bring the protruded portion 30*p* into contact with the handle stopper 32*a* (in this case, left-side stopper). On the other hand, when the handle 10 is steered to the right, the pin 33*b* pushes the throttle lever Lt to be operated a in similar way, although this is not shown in FIGS. 4A, 4B.

The throttle lever Lt is generally manufactured from a lightweight material such as synthetic resin or aluminum and the protector plate 39 is preferably manufactured from an abrasion-resistant material to reduce the abrasion of the throttle lever Lt at the area which the pins 33*a*, 33*b* make contact there with.

As shown in FIG. 4B, when the handle 10 is at a proximity of the neutral steering position in which the protruded portion 30*p* is not in contact with any of the handle stoppers 32*a,* 32*b,* the pins 33*a,* 33*b* are configured not to make contact with the throttle lever Lt.

As should be appreciated, when the handle 10 is fully steered to the right or to the left, the throttle lever Lt is rotated toward the open direction (direction to open the throttle) by a predetermined amount due to the protrusion of any of the pins 33*a,* 33*b.* Therefore, even if the throttle-close operation is being performed, the throttle can be forcibly opened, thereby allowing the steering to be maintained (steering assist mode control). Such steering state can be maintained while the rider is substantially fully steering the handle 10, and released when the rider steers the handle 10 back to the neutral position to cause the pin 33*a* or 33*b* to be out of contact with the throttle lever L or operates the throttle lever Lt to be rotated toward the open direction more than the pushing amount of the protruded pin 33*a* or 33*b.* That is, with this configuration, since the throttle lever Lt has been rotated to the open direction in the normal drive state, it does not make contact with the pin 33*a* or 33*b.*

Second Embodiment

The throttle lever L can be also rotated directly according to the operation of the handle 10 in the following manner. In this embodiment, the two push-pull cables 31*a,* 31*b* are replaced by one push-pull cable 31*c,* as shown in FIG. 6.

The opposite end portions of the cable 31*c* are mounted in the same manner that the end portions of the cables 31*a,* 31*b* on the throttle lever side are mounted. The cable 31*c* is configured such that it has an uncovered middle portion of a predetermined length so as to expose an inner wire thereof. The opposing ends of the separated two outer cable covers are respectively fixed to cable holders 34*a,* 34*b* of the handle stoppers 32*a,* 32*b* such that they are protruding by a predetermined length. The inner wire of the cable 31*c* between the cable holders 34*a,* 34*b* is inserted into a guide hole 31*h* formed laterally of the protruded portion 30*p* of the annular disc 30.

Washer-type stoppers 34*wa,* 34*wb* are fixed to a predetermined position of the inner wire of the cable 31*c* on the right and left sides of the guide hole 31*h.* A return spring 34*pa* is interposed between the stopper 34*wa* and an end portion 36*a* of the outer cable cover fixed to the handle-stopper 32*a* and a return spring 34*pb* is interposed between the stopper 34*wb* and an end portion 36*b* of the outer cable cover fixed to the handle stopper 32*b.* These return springs 34*pa,* 34*pb* are constituted by coil springs.

Figure 6:
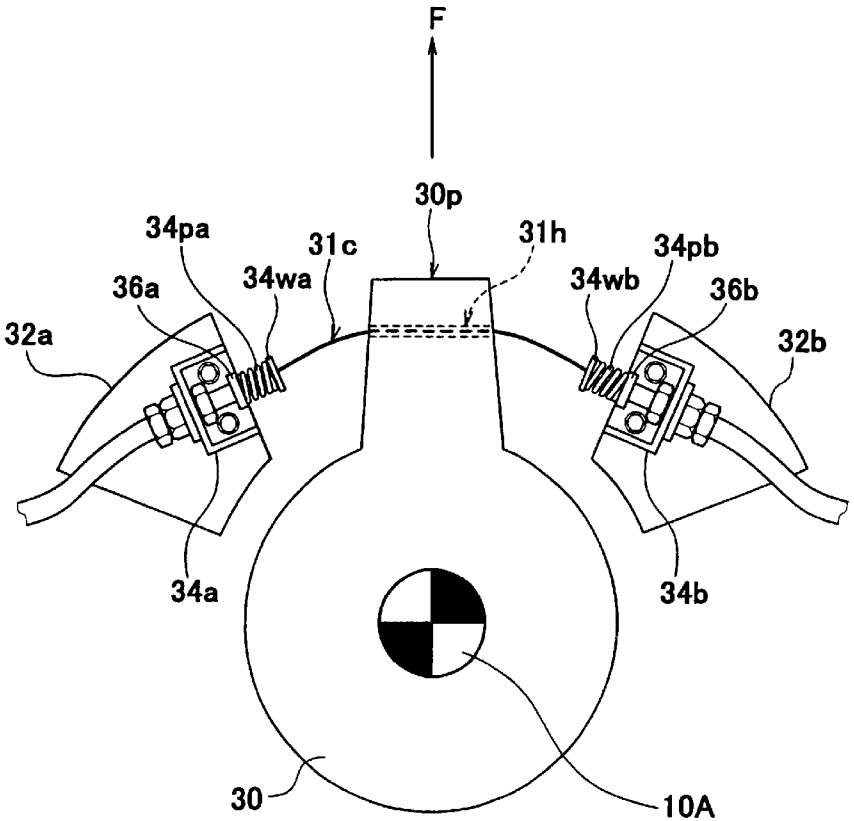
FIG. 6 is a plan view showing a structure in the vicinity of a rotational shaft of a personal watercraft according to a second embodiment.

With the above-described configuration, for example, when the handle 10 is steered to the left, the annular disc 30 rotates counterclockwise in FIG. 6. At this time, the inner wire of the cable 31*c* slides in the guide hole 31*h* of the protruded portion 30*p* and is not pushed to the left. In time, the protruded portion 30*p* is brought into contact with the left-side stopper 34*wa* and pushes the stopper 34*wa* to the left, i.e., the end portion 36*a* against the return spring 34*pa.* Thereby, the inner wire of the cable 31*c* integral with the stopper 34*wa* pushes the pin 33*a* to cause the throttle lever Lt to be swung to open the throttle similarly to the operation in the configuration of FIG. 5A. On the other hand, the pin 33*b* is pulled in by the end portion of the opposite-side inner wire of the cable 31*c* connected thereto. Also, when the handle 10 is steered to the right, the reverse operation is performed, which is not described herein.

Thus, the amounts of the end portions 36*a,* 36*b* of the cable 31*c* protruding from the cable holders 34*a,* 34*b* are varied for easy adjustment of the protruding amounts of the pins 33*a,* 33*b.*

Third Embodiment

In the first and second embodiments, the steering capability can be maintained, that is, the steering assist mode control is executed, by using the mechanical members such as the push-pull cables, while the throttle-close operation is performed. In this embodiment, the steering assist mode control is executed in a different manner as described below.

Figure 7:
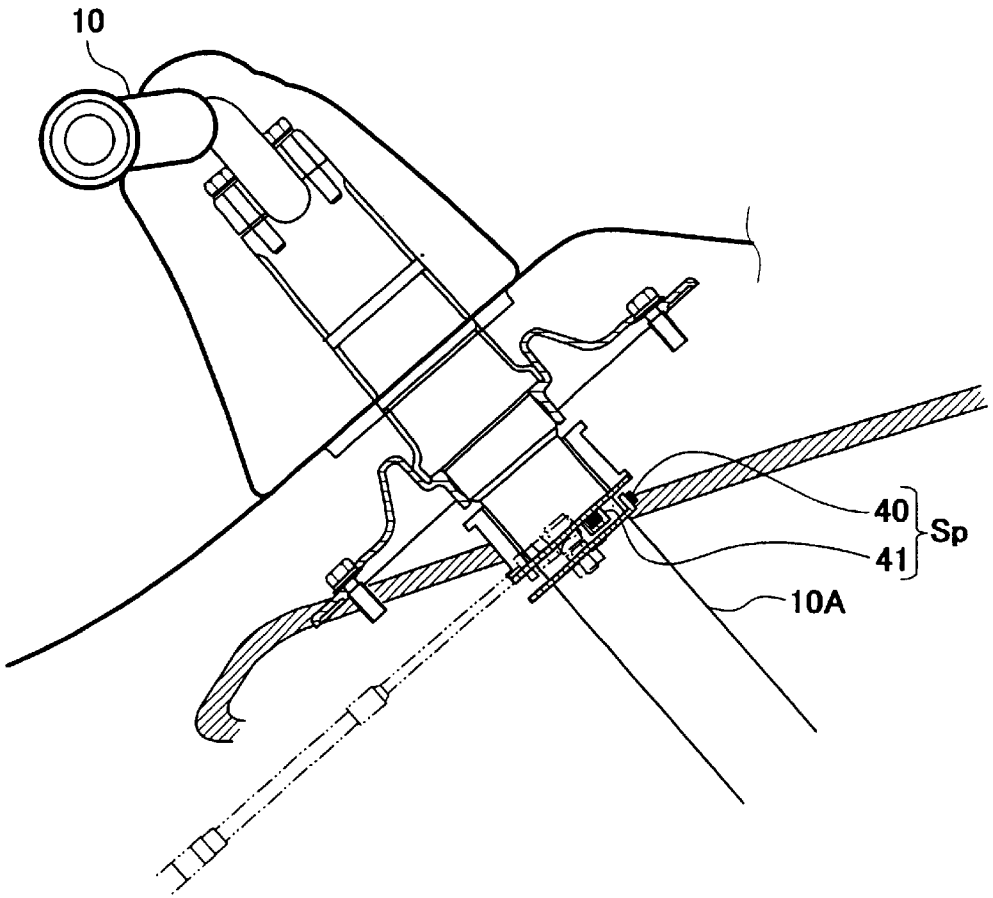
FIG. 7 is a partially cross-sectional side view showing a steering mechanism of a personal watercraft according to a third embodiment.
Figure 8:
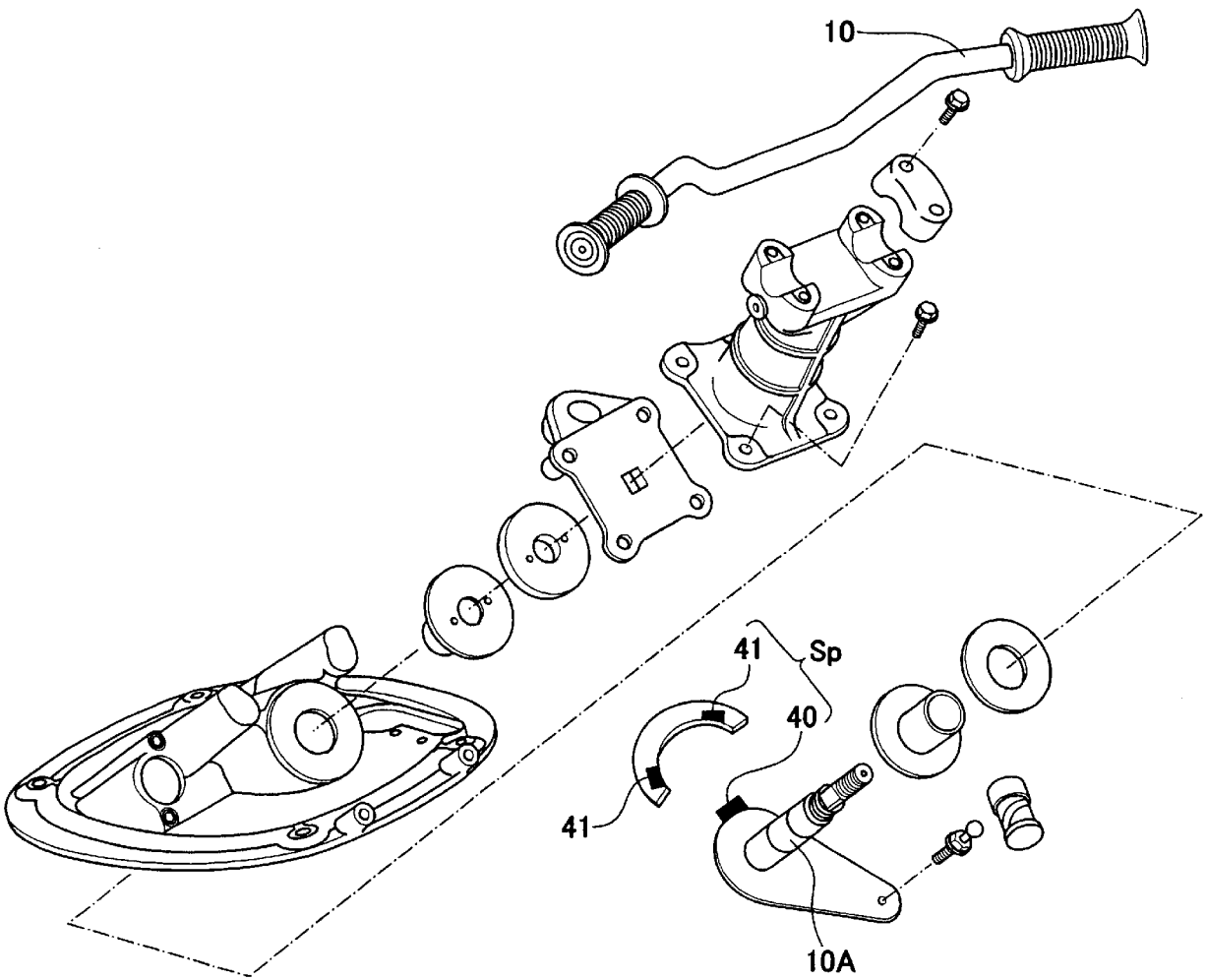
FIG. 8 is a partially exploded perspective view showing the steering mechanism of FIG. 7.

FIG. 7 is a partially cross-sectional side view of a steering mechanism of the personal watercraft of this embodiment. FIG. 8 is a partially exploded perspective view showing the steering mechanism. As shown in FIGS. 7, 8, the steering mechanism is provided with a steering position sensor Sp. The steering position sensor Sp is constituted by a permanent magnet 40 and a pair of proximity switches 41. The permanent magnet 40 is attached to a portion of an annular-plate member fixed to the rotational shaft 10A of the steering handle 10. The proximity switches 41 are respectively provided at positions spaced apart from the permanent magnet 40 such that each of these switches forms a predetermined angle (e.g., 20 degrees) clockwise or counterclockwise with respect to the permanent magnet 40. When the steering handle 10 is rotated by the predetermined angle and the permanent magnet 40 comes close to the corresponding proximity switch 41, the switch 41 is turned ON, thereby detecting a steering operation.

In the present invention, the steering position sensor Sp need not be constituted by the above-described proximity switches but may be constituted by a non-contact type sensor such as a potentiometer or a contact type sensor.

Figure 9:
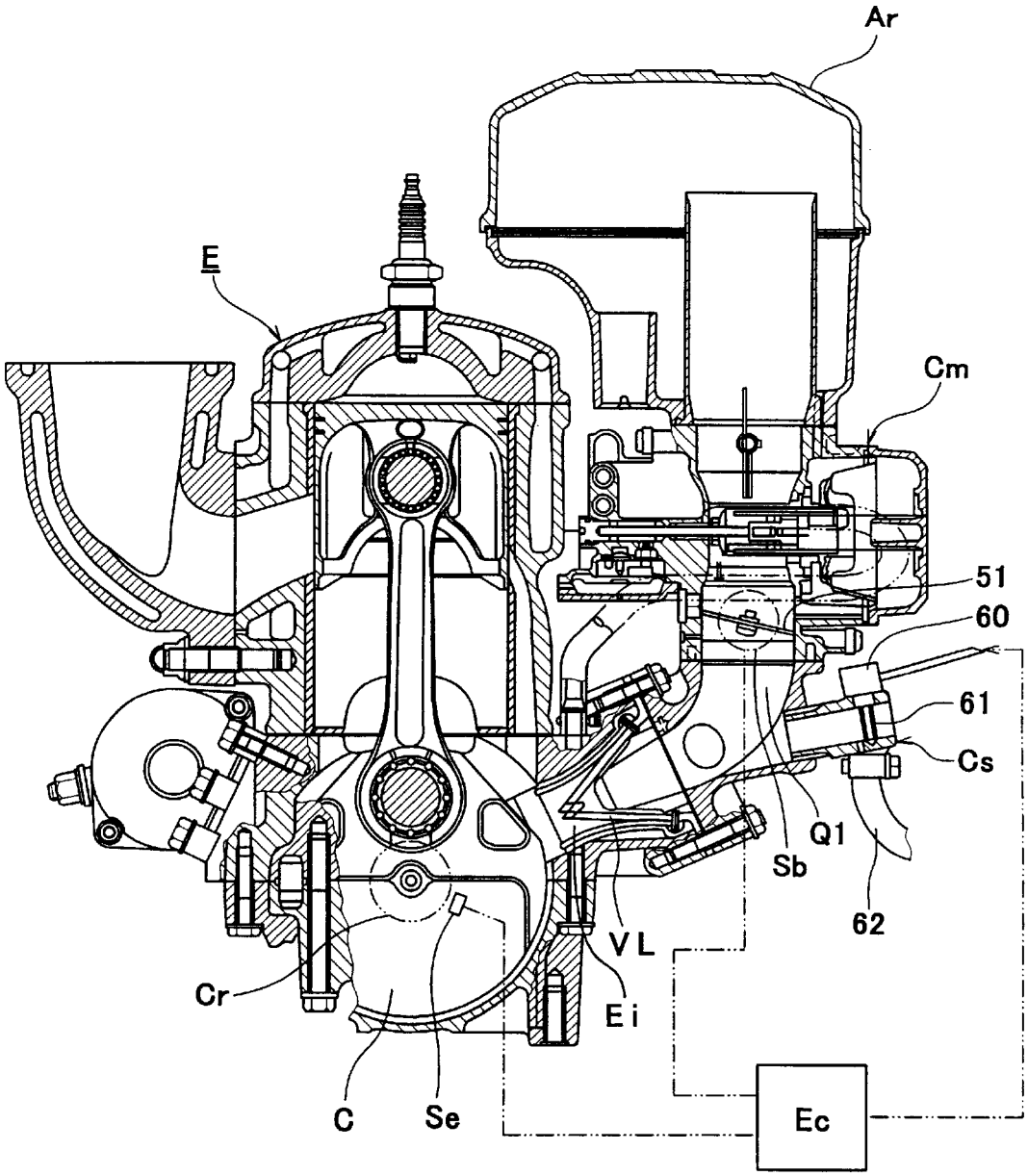
FIG. 9 is a view showing a configuration of a control system of a personal watercraft according to a third embodiment based on the relationship with an engine.
Figure 10:
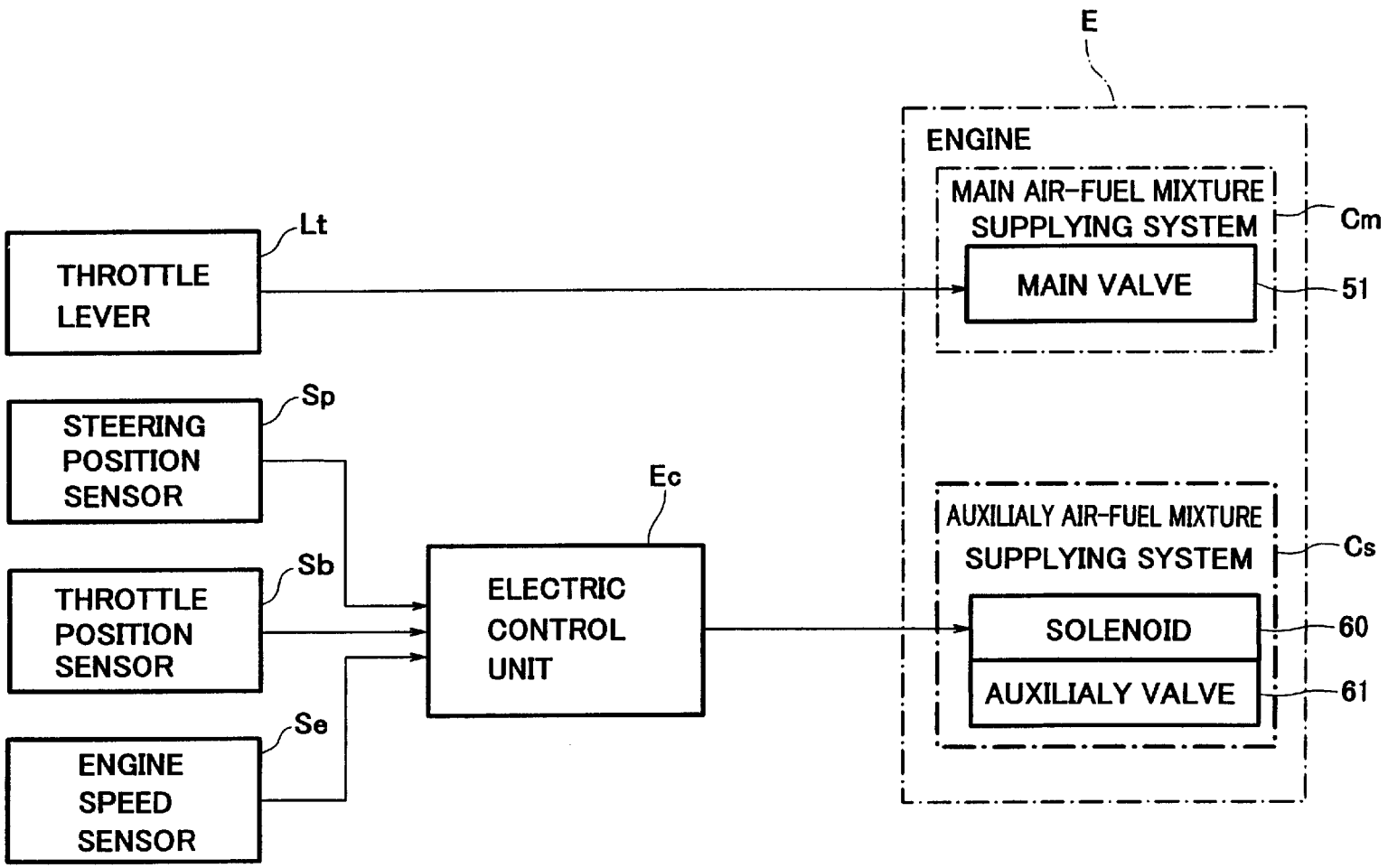
FIG. 10 is a block diagram showing the configuration of the control system of the personal watercraft according to the third embodiment.

FIG. 9 is a view showing a configuration of a control system of the personal watercraft of this embodiment based on the relationship with the engine and FIG. 10 is a block diagram of FIG. 9. Referring to FIG. 9, Cm denotes a main air-fuel mixture supplying system generally provided in the engine E, and the main air-fuel mixture supplying system Cm is connected to an intake port Ei of the engine E through a main air-fuel mixture supplying passage Q1. The intake port Ei is provided with a lead valve VL that permits the flow of the fuel (air-fuel mixture) vaporized in the main air-fuel mixture supplying system Cm toward the engine E and prevents the back flow thereof. Thereby, the air-fuel mixture from the main air-fuel mixture supplying system Cm flows through the main air-fuel mixture supplying passage Q1 via a main valve (throttle valve) 51 for controlling the flow of the air-fuel mixture and flows into a crankcase C via the lead valve VL and the intake port Ei of the engine E in this order.

The main air-fuel mixture supplying system Cm is provided with a throttle position sensor Sb placed close to the main valve 51 provided in the main air-fuel mixture supplying passage Q1, for detecting that the main valve 51 is closed to some degree, i.e., a throttle-close operation. In this embodiment, a so-called butterfly-type throttle valve is employed as the main valve 51 of the main air-fuel mixture supplying system Cm but this is only illustrative. For example, a slide-type throttle valve may be employed. An engine speed sensor Se is provided in the vicinity of the crankshaft Cr, for detecting the number of revolutions of the crankshaft Cr, i.e., the engine speed of the engine E.

As shown in FIG. 9, an auxiliary air-fuel mixture supplying system Cs is provided between the main valve 51 of the main air-fuel mixture supplying system Cm that serves to supply the air-fuel mixture to the engine E in the normal drive and the intake port Ei. The auxiliary air-fuel mixture supplying system Cs has an air-fuel mixture supply capacity smaller than that of the main air-fuel mixture supplying system Cm. Depending on the configuration of the main air-fuel mixture supplying system Cm, the auxiliary air-fuel mixture supplying system Cs may be provided at any position in an air-intake passage between an air-intake box (air cleaner box) Ar of the main air-fuel mixture supplying system Cm and the intake port Ei.

In this embodiment, the auxiliary air-fuel mixture supplying system Cs has a so-called venturi-type fuel carburetion structure in which air taken in an air supplying passage generates a negative pressure in a small-diameter opening (needle jet) formed in the way of and communicating with the air supplying passage, to suction and vaporize the fuel flowing through a fuel supplying passage 62 connected to the opening. The auxiliary air-fuel mixture supplying system Cs comprises a control system independent of that of the main air-fuel mixture supplying system Cm controlled by the operation of the throttle lever Lt (see FIG. 10) by the rider. Specifically, the auxiliary air-fuel mixture supplying system Cs is provided with a slide-type auxiliary valve (needle valve) 61 in the air supplying passage. The auxiliary valve 61 is opened/closed by the operation of a solenoid 60. The auxiliary valve 61 is not limited to the slide-type valve, but a valve of another configuration such as a butterfly-type valve may be employed.

As mentioned in detail later, in the auxiliary air-fuel mixture supplying system Cs, while the throttle-close operation is performed, the solenoid 60 becomes conductive according to an instruction signal from the electric control unit Ec, causing the auxiliary valve 61 to be opened. Thereby, the air-fuel mixture can be supplied to the engine E even while the air-fuel mixture is not supplied to the engine E from the main air-fuel mixture supplying system Cm.

Referring to FIG. 10, the steering position sensor Sp, the throttle position sensor Sb, and the engine speed sensor Se are respectively connected to the electric control unit Ec through signal lines (electric wires). A signal indicating that the steering operation, the throttle-close operation, or the engine speed has been detected by the steering position sensor Sp, the throttle position sensor Sb, or the engine speed sensor Se, is sent to the electric control unit Ec. The electric control unit Ec is connected to the solenoid 60 of the auxiliary air-fuel mixture supplying system Cs by means of a signal line (electric wire) through a drive circuit (not shown).

Figure 11:
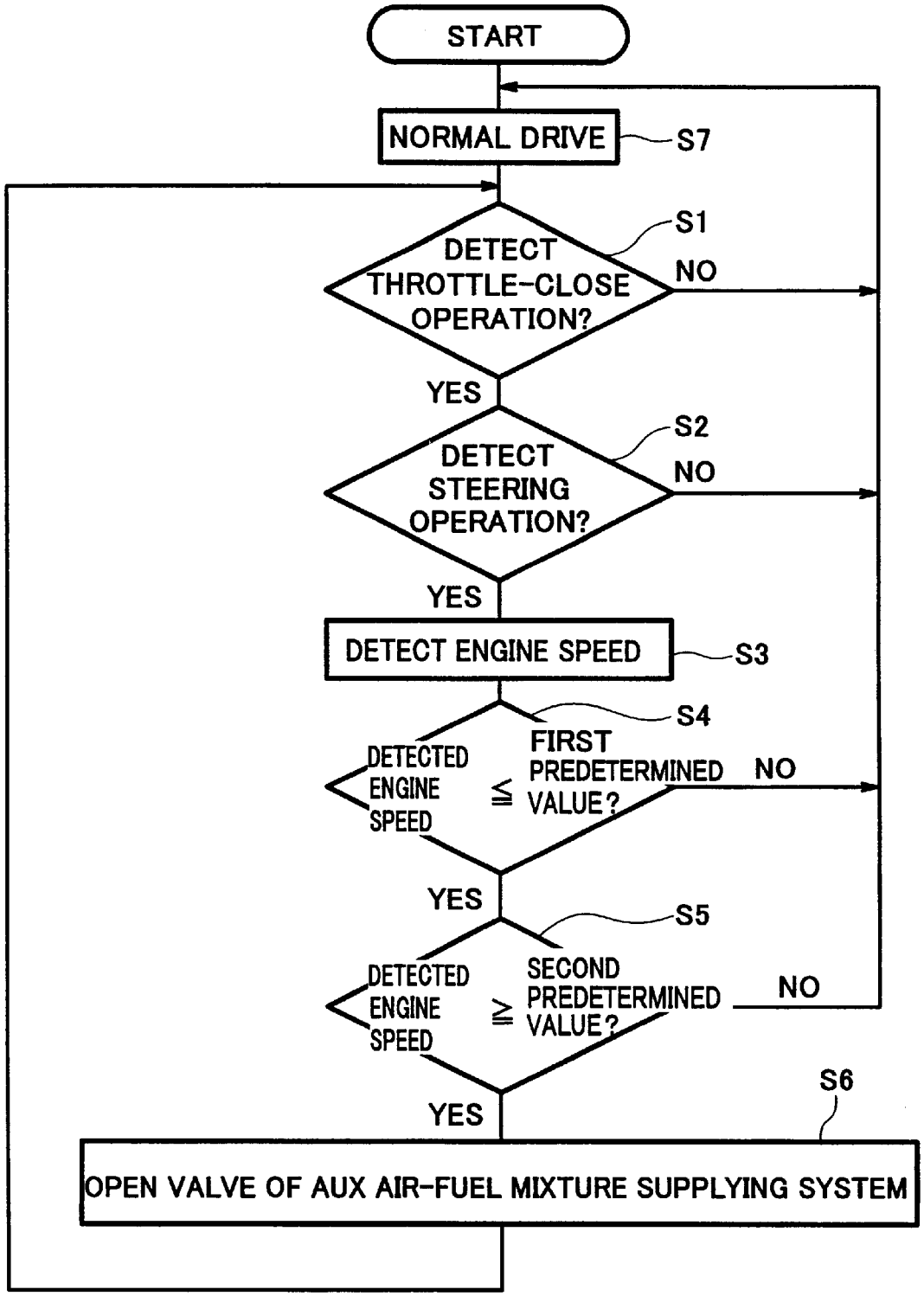
FIG. 11 is a flowchart showing a control process performed under steering assist mode control of the personal watercraft according to the third embodiment.

Thus, the personal watercraft of this embodiment includes the above-identified hardware configuration. As described below, when predetermined conditions such as the throttle-close operation occur, transition to the steering assist mode control takes place. The personal watercraft has a function of maintaining steering capability even while the throttle (main valve 51) is closed. This function is performed by making the electric control unit Ec execute a computer program stored in a memory built in the electric control unit Ec. Subsequently, a control process according to the computer program will be described with reference to the flowchart of FIG. 11.

When the personal watercraft of this embodiment is cruising, first of all, the electric control unit Ec judges whether or not the throttle position sensor Sb has detected that the rider performed the throttle-close operation (Step S1).

When judging that the throttle-close operation has been detected by the throttle position sensor Sb ("YES" in Step S1), the electric control unit Ec judges whether or not the steering position sensor Sp has detected that the rider rotated the steering handle 10 by the predetermined angle to the right or to the left (Step S2).

When judging that the steering operation has been detected ("YES" in Step S2), the electric control unit Ec reads the engine speed detected by the engine speed sensor Se (Step S3) and then judges whether or not the detected engine speed is smaller than a first predetermined value (e.g. approximately 2500 rpm or approximately 5500 rpm) (Step S4).

When judging that the engine speed is smaller than the first predetermined speed ("YES" in Step S4), the electric control unit Ec judges whether or not the engine speed is larger than a second predetermined value (e.g. idling engine speed of approximately 800–2000 rpm) (Step S5). This judgment is made to prevent the steering assist mode control from being executed in the idling state. This is because the propulsion force is unnecessary in the idling state in which the watercraft is not moving.

On the other hand, when judging that the throttle-close operation has not been detected ("NO" in Step S1), the steering operation has not been detected ("NO" in Step S2), the engine speed is larger than the first predetermined value ("NO" in Step S4), or the engine speed is smaller than the second predetermined value ("NO" in Step S5), the electric control unit Ec maintains an initial drive state, i.e., a normal drive state (Step S7).

When judging that the engine speed is larger than the second predetermined value ("YES" in Step S5), the electric control unit Ec starts the steering assist mode control to open the auxiliary valve 61 of the auxiliary air-fuel mixture supplying system Cs (Step S6), thereby increasing the engine speed.

In this embodiment, in view of a turning characteristic of the personal watercraft, a characteristic due to the hull shape of the watercraft, and the like, the engine speed may be increased up to approximately 2500–3500 rpm. For example, the engine speed may be fixed at approximately 3000 rpm or may vary depending on the cruising state of the watercraft.

As the engine speed is employed in the judgment in Steps S4, S5, it is desirable to adopt statistical values of sampling results during a given time period rather than a value of one sampling result, taking inertia of the cruising personal watercraft into account.

The electric control unit Ec repeats Steps S1–S6 until it judges "NO" in Step S1, S2, S4, or S5. When judging "NO", the electric control unit Ec closes the auxiliary valve 61 which was opened to increase the engine speed, and sets back the conditions of the watercraft to the initial drive state, i.e., the normal drive state (Step S7).

In judgment as to whether to start the steering assist mode control, alternatively, Steps 1, 2 may be performed in the reversed order. Also, according to the judgment in Step S2 and the judgment of the engine speed in Steps S4, S5, the steering assist mode control may be started. Likewise, Steps S4, S5 may be performed in the reversed order. Also, Step S4 or S5 may be omitted. Further, Step S1 may be omitted and the judgment of the throttle-close operation may be made in Step S4 and/or Step S5.

A speed sensor may be provided for detecting the cruising speed of the watercraft and the cruising speed detected by the speed sensor may be used in substitution for the engine speed.

The main air-fuel mixture supplying system Cm and the auxiliary air-fuel mixture supplying system Cs adopted in this embodiment is of a so-called carburetor type. The steering assist mode control can be executed by using air-fuel mixture supplying systems of a fuel injection type in a similar way. In this case, the main valve 51 is provided in the passage generally called as an air-intake passage between the air-intake box Ar and the intake port Ei of the engine E, and the auxiliary air-fuel mixture supplying system Cs is provided between the main valve 51 and the intake port Ei. Also, the main air-fuel mixture supplying system Cm and the auxiliary air-fuel mixture supplying system Cs need not have the same configuration such as the carburetor type, and may have different configurations.

Further, instead of driving the auxiliary valve 61 of the auxiliary air-fuel mixture supplying system Cs by the solenoid 60 as described in this embodiment, the auxiliary valve 61 may be driven by the push-pull wires of the first and second embodiments. Specifically, the end portions of the push-pull wires connected to the throttle lever Lt may be connected to the auxiliary valve 61 so that the advancement/retraction of these end portions causes the auxiliary valve 61 to be opened/closed.

The personal watercraft of this embodiment includes the above-identified configuration and function. Since the other configuration and function are identical to those of the first and second embodiments, the corresponding parts are referenced to by the same reference numerals and the detailed description thereof is omitted.

Fourth Embodiment

Figure 12:
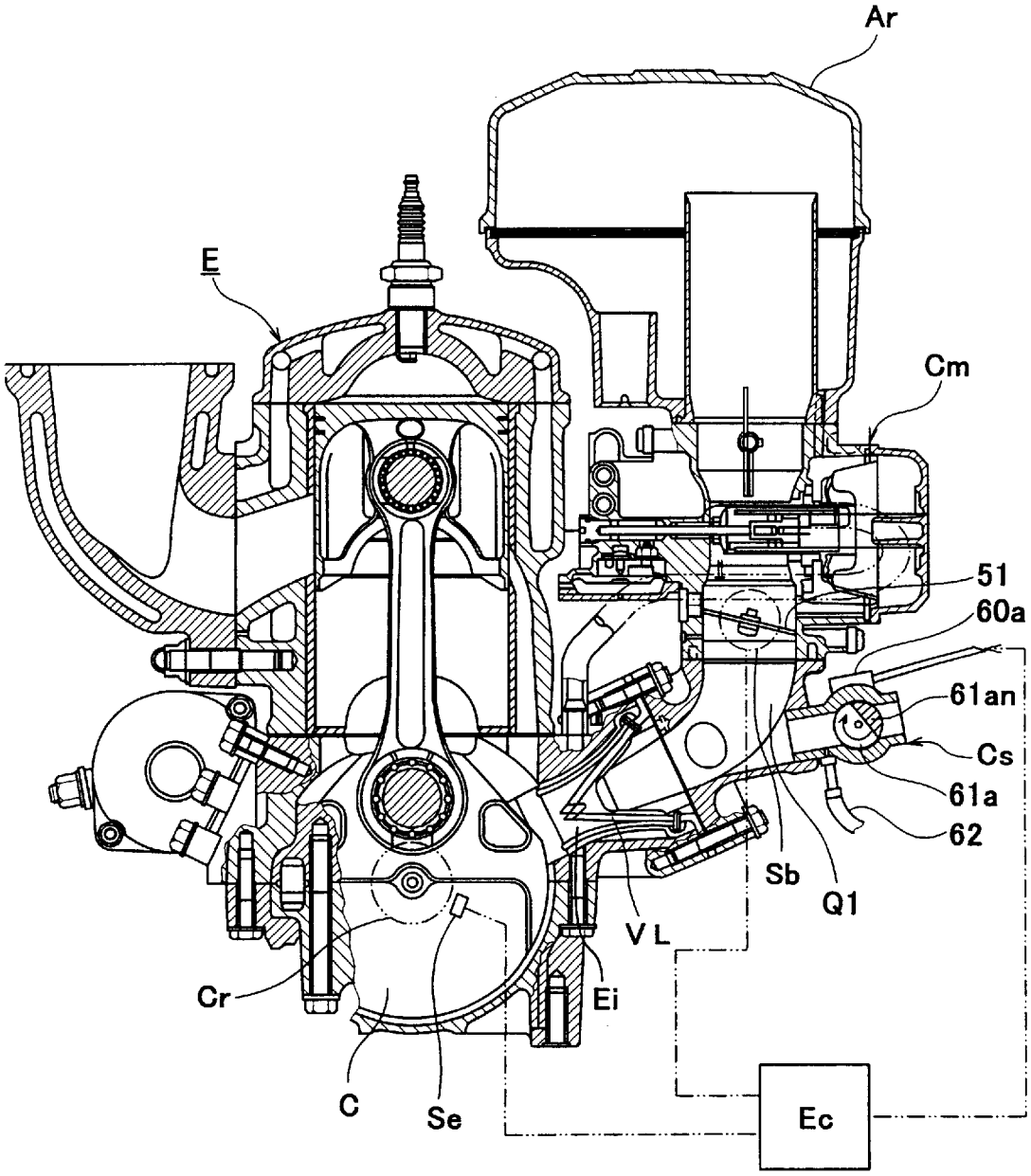
FIG. 12 is a view showing a configuration of a control system of a personal watercraft according to a fourth embodiment based on the relationship with the engine.

The auxiliary air-fuel mixture supplying system Cs of the third embodiment can be configured as described below. In this embodiment, the slide-type auxiliary valve 61 may be replaced by a rotary-type auxiliary valve 61*a* as shown in FIG. 12. The rotary-type auxiliary valve 61*a* is drum-shaped and includes a rotational shaft orthogonal to the direction in which air flows through an air supplying passage. The auxiliary valve 61*a* is configured to occlude the air supplying passage. The auxiliary valve 61*a* lacks part of a peripheral face thereof, which part is referenced to by reference numeral 61*an*. This lack portion 61*an* allows the air supplying passage to be opened according to rotation of the auxiliary valve 61*a*.

Also, the auxiliary valve 61*a* is opened/closed (rotated) by a solenoid 60*a* provided on the auxiliary valve 61*a* eccentrically with respect to the center of rotation thereof. The solenoid 60*a* can be controlled by the electric control unit Ec similarly to the third embodiment.

The personal watercraft of this embodiment includes the above-identified configuration and function. Since the other configuration and function are identical to those of the third embodiment, the corresponding parts are referenced to by the same reference numerals and the detailed description thereof is omitted.

Fifth Embodiment

In the third and fourth embodiments, the auxiliary air-fuel mixture supplying system Cs is provided in the main air-fuel mixture supplying passage Q1 between the main valve 51 of the main air-fuel mixture supplying system Cm and the intake port Ei. In this fifth embodiment, the auxiliary air-fuel mixture supplying system Cs is configured in a different manner as described below.

Figure 13:
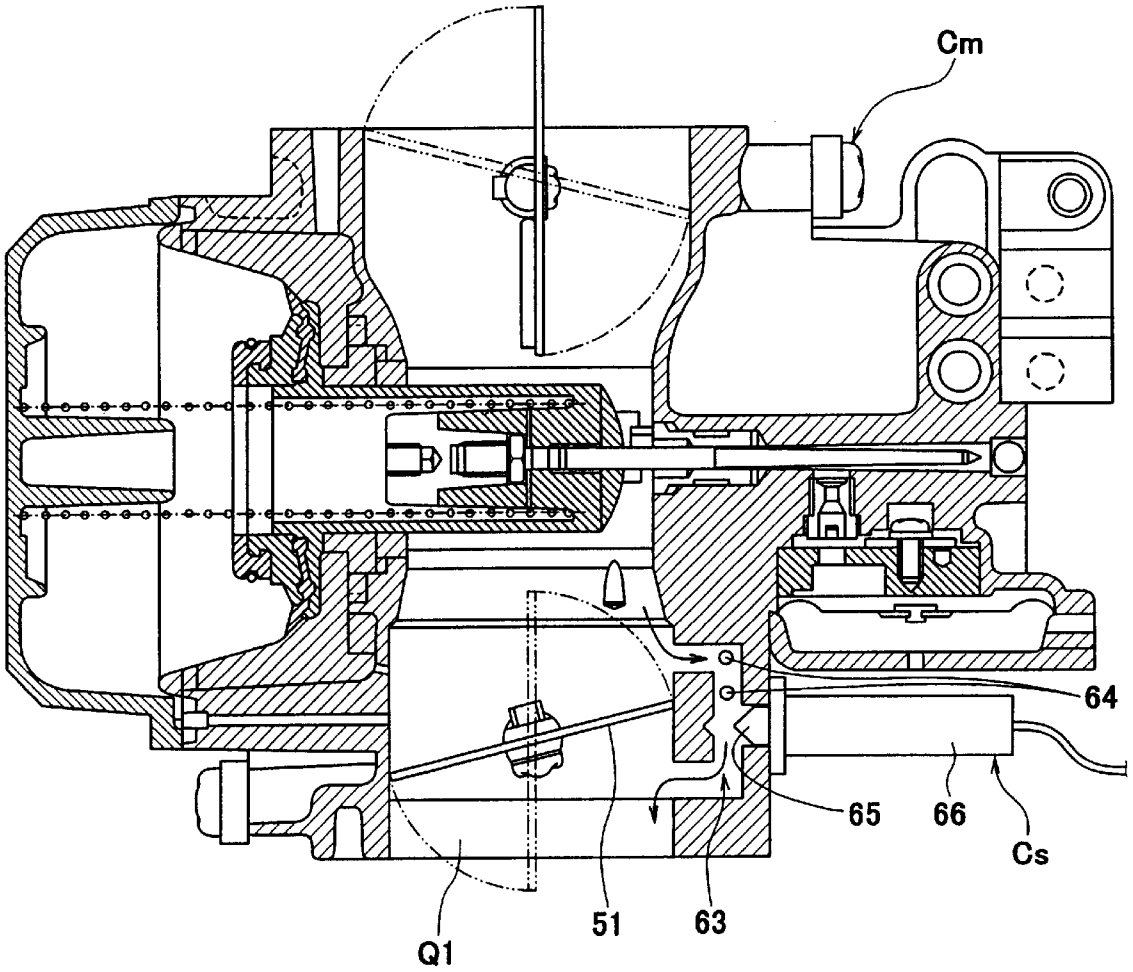
FIG. 13 is a partially cross-sectional view showing a structure of air-fuel mixture supplying systems of a personal watercraft according to a fifth embodiment.

Referring to FIG. 13, in the personal watercraft of this embodiment, the auxiliary air-fuel mixture supplying system Cs is provided in a housing portion in the vicinity of the main valve 51 of the main air-fuel mixture supplying system Cm.

Specifically, the auxiliary air-fuel mixture supplying system Cs is provided in a housing of the main air-fuel mixture supplying system Cm and is provided with a bypass passage 63 that bypasses the main air-fuel mixture supplying passage Q1 at a position upstream of the main valve 51 and at a position downstream of the main valve 51. A plurality of (two in FIG. 13) small-diameter openings 64 are formed in the bypass passage 63 and are connected to a fuel supplying passage (not shown). Therefore, the bypass passage 63 also serves as a so-called venturi-type air-fuel mixture supplying system, in which the bypass passage 63 is opened/closed by the operation of an auxiliary valve 65 provided downstream of the openings 64 of the bypass passage 63 so that the fuel-air mixture is or is not supplied.

As shown in FIG. 13, the auxiliary valve 65 is of a slide type and can advance or retract along a hole formed from outside of the hosing to the inside of the bypass passage 63. The auxiliary valve 65 can be opened/closed by a solenoid 66 controlled by the electric control unit Ec similarly to the auxiliary valves 61, 61*a* of the third and fourth embodiments.

Therefore, the auxiliary air-fuel mixture supplying system Cs of this embodiment also comprises a control system independent of that of the main air-fuel mixture supplying system Cm controlled by the operation of the throttle lever Lt by the rider. While the throttle-close operation is performed, the solenoid 66 becomes conductive according to the instruction signal from the electric control unit Ec, causing the auxiliary valve 65 to be opened. Thereby, the air-fuel mixture is supplied to the engine E even while the main valve 51 is closed and therefore, the air-fuel mixture is not supplied to the engine E by the main air-fuel mixture supplying system Cm.

In this embodiment, the supplied fuel is dependent upon the amount of air flowing through the bypass passage 63 according to the open/close operation of the auxiliary valve 65. Alternatively, for example, when the rich air-fuel mixture is supplied from the main air-fuel mixture supplying system Cm at the throttle-close operation, the openings 64 may be closed or the like to allow only the air to be supplied, thereby increasing the engine speed of the engine E. On the other hand, when the lean air-fuel mixture is supplied from the main air-fuel mixture supplying system Cm at the throttle-close operation, the inlet (upstream of the openings 64) of the bypass passage 63 may be closed or the like to allow only the fuel to be supplied, thereby increasing the engine speed of the engine E. This configuration to supply only air or fuel from the auxiliary air-fuel mixture supplying system Cs is applicable to the configurations of the third and fourth embodiments.

The personal watercraft of this embodiment includes the above-identified configuration and function. Since the other configuration and function are identical to those of the third and fourth embodiments, the corresponding parts are referenced to by the same reference numerals and the detailed description thereof is omitted.

Sixth Embodiment

The personal watercraft of this sixth embodiment differs from that of the third embodiment in that the auxiliary air-fuel mixture supplying system Cs is separated from the main air-fuel mixture supplying passage Q1 of the main air-fuel mixture supplying system Cm and is connected to the main air-fuel mixture supplying passage Q1 indirectly through a predetermined connecting passage. Thereby, the degree of freedom at which the auxiliary air-fuel mixture supplying system Cs is mounted can be increased.

Figure 14:
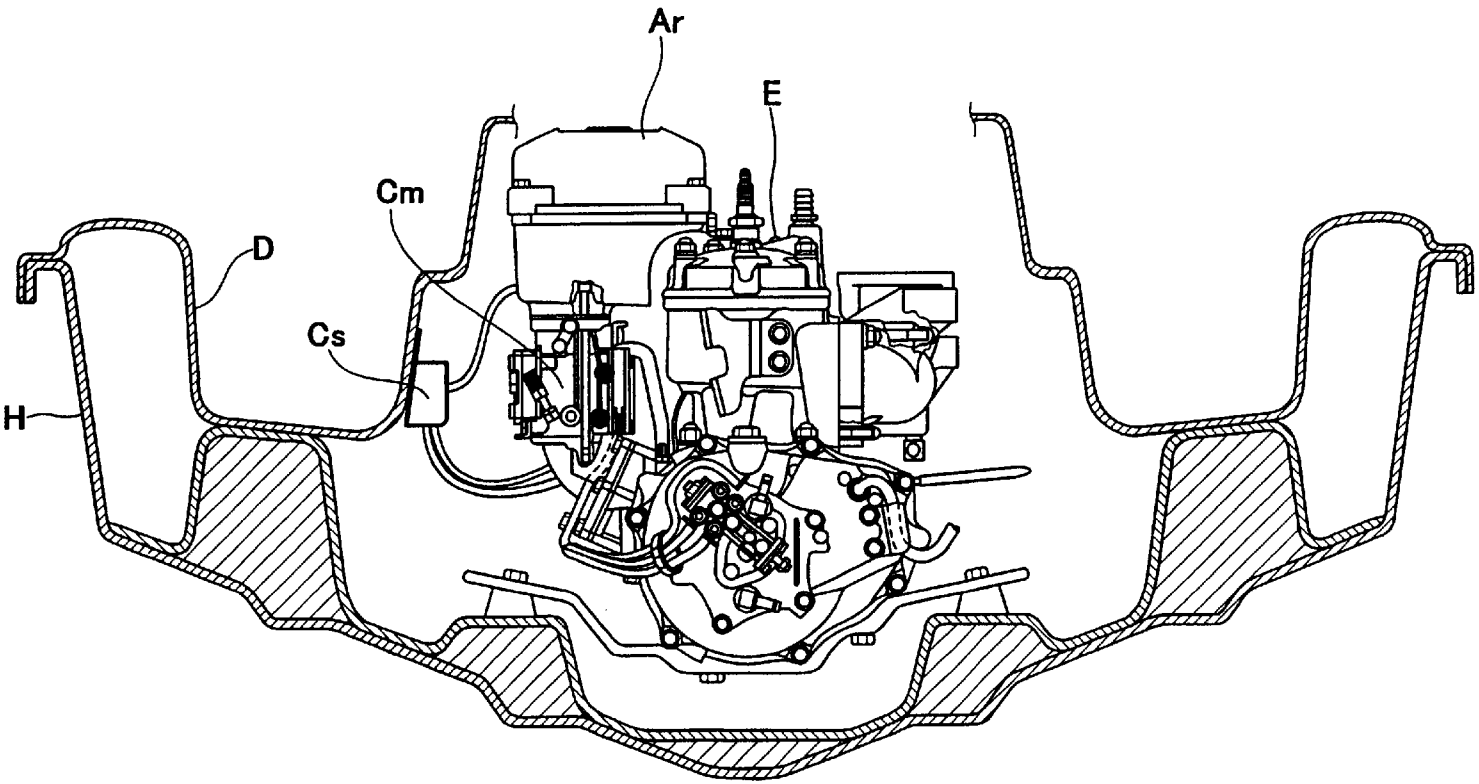
FIG. 14 is a cross-sectional view taken substantially along the line XIV—XIV of FIG. 2 and showing placement of the engine of the personal watercraft according to a sixth embodiment and air-fuel mixture supplying systems thereof.

As shown in FIG. 14 as a cross-sectional view taken along line XIV—XIV of the personal watercraft of FIG. 2, the main air-fuel mixture supplying system Cm is provided on one side (right side) of the engine E. The air-intake box (air cleaner box) Ar is provided above the main air-fuel mixture supplying system Cm. The air-intake box Ar has a labyrinth-shaped (or inverted-U shaped) air-intake structure to supply clean air to the main air-fuel mixture supplying system Cm and prevent the entry of water from outside. In this embodiment, the air-intake box Ar is used as means to prevent the entry of liquid. Instead of this, a labyrinth structure independently provided or an inverted-U shaped tub independently provided may be employed.

Figure 15:
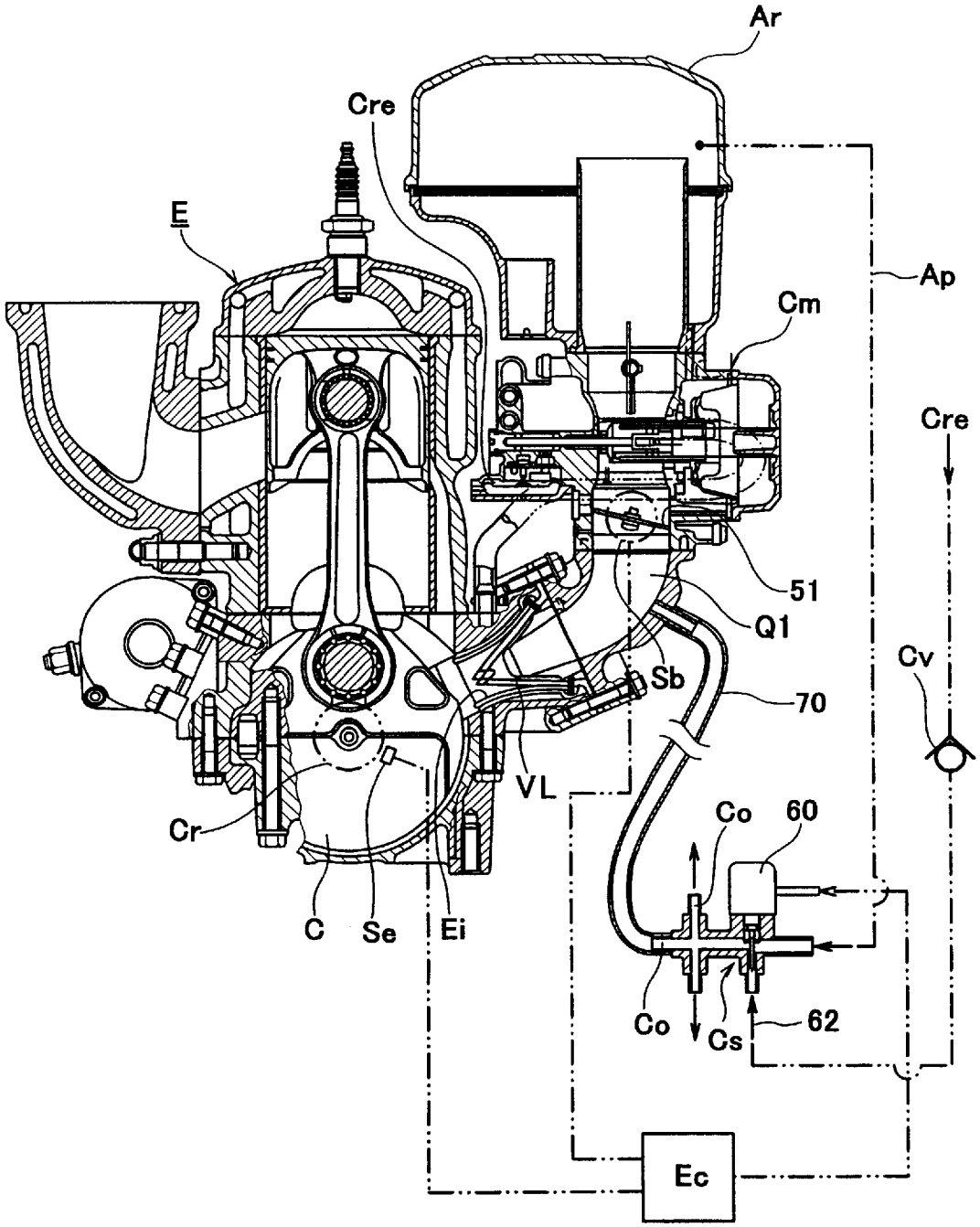
FIG. 15 is a view showing a configuration of a control system of the personal watercraft according to the sixth embodiment based on the relationship with the engine.

In this embodiment, as shown in FIG. 15, air-fuel mixture supplying ports Co of the auxiliary air-fuel mixture supplying system Cs having the air-fuel mixture supply capacity smaller than that of the main air-fuel mixture supplying system Cm is connected through connecting passages 70 to the main air-fuel mixture supplying passages Q1 between the main valve 51 of the main air-fuel mixture supplying system Cm serving to supply the air-fuel mixture to the engine E in the normal drive state and the intake ports Ei of corresponding cylinders. As shown in FIG. 14, the auxiliary air-fuel mixture supplying system Cs is mounted to a portion of the watercraft which is within a vibration system independent of that of the engine E, more specifically, an inner wall of the deck D, by means of vibration-proof rubber (not shown). The engine E is mounted to a floor face of the hull H by means of a mounting member and the vibration-proof rubber. Thereby, the auxiliary air-fuel mixture supplying system Cs is capable of stably supplying the air-fuel mixture to the engine E without pulsation due to the vibration of the engine E when the fuel is supplied to the auxiliary air-fuel mixture supplying system Cs.

While in this embodiment, the auxiliary air-fuel mixture supplying system Cs is mounted to the inner wall of the deck D, the placement is not limited to this so long as the auxiliary air-fuel mixture supplying system Cs is within a vibration system different from the vibration system of the engine E mounted to the floor face of the hull H. For example, the auxiliary air-fuel mixture supplying system Cs may be directly mounted to the engine E via a vibration-proof device or may be mounted to the inner wall of the hull H.

Figure 16:
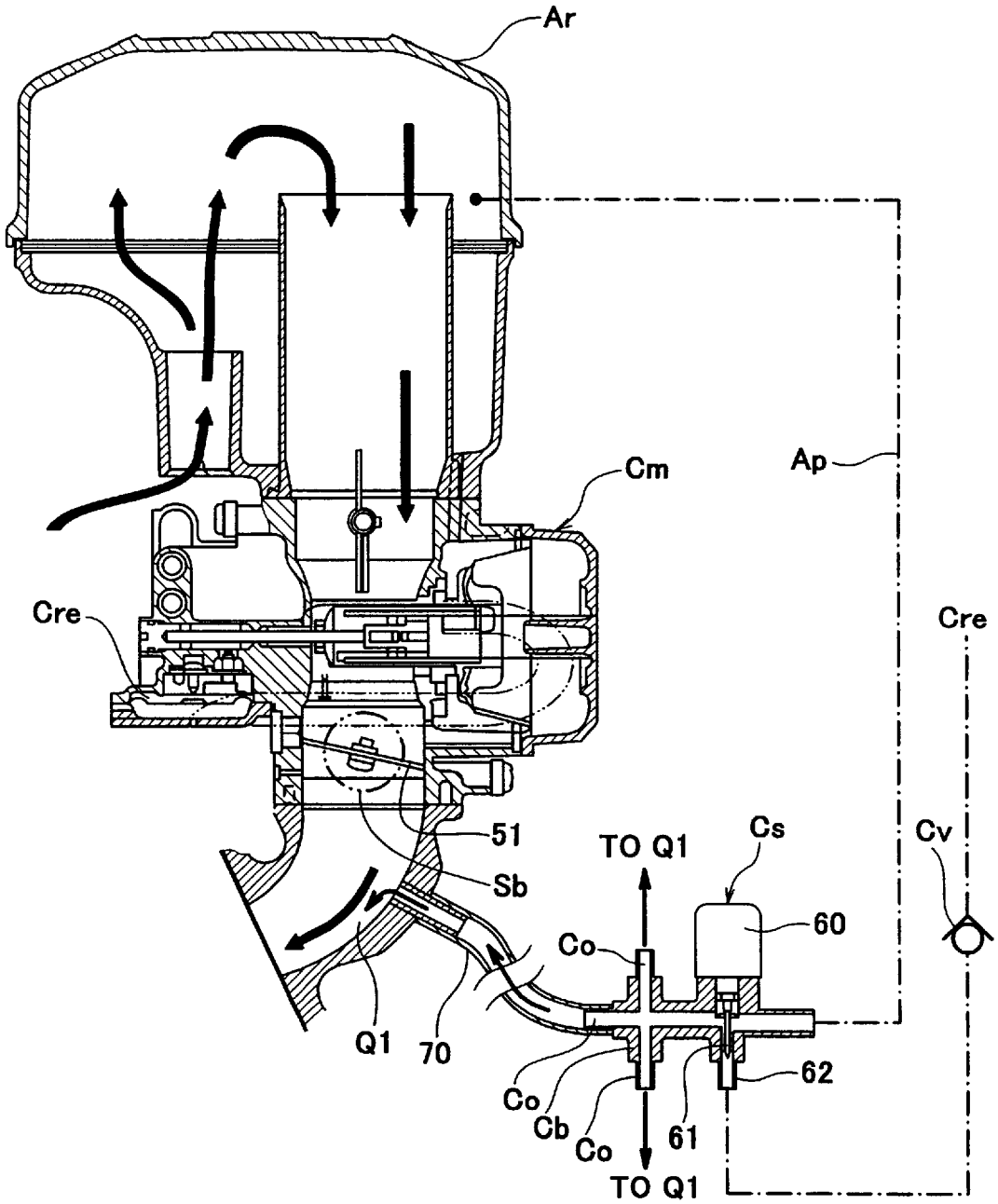
FIG. 16 is a detailed enlarged view showing air-fuel mixture supplying systems of FIG. 15.

As shown in FIG. 16, the auxiliary air-fuel mixture supplying system Cs has a so-called venturi-type fuel carburetion structure, in which the air supplied from the air-intake box Ar through the air passage Ap generates the negative pressure in the small-diameter opening (needle jet) formed in the middle of the air supplying passage of the auxiliary air-fuel mixture supplying system Cs, to suction and vaporize the fuel flowing through the fuel supplying passage 62 connected to the opening. In this embodiment, the fuel supplying passage 62 is connected to a regulator chamber Cre of the main air-fuel mixture supplying system Cm via a check valve Cv. The check valve Cv permits only the flow of the fuel from the regulator chamber Cre of the main air-fuel mixture supplying system Cm toward the auxiliary air-fuel mixture supplying system Cs.

As schematically shown in FIGS. 15, 16, the main air-fuel mixture supplying system Cm and the auxiliary air-fuel mixture supplying passage Cs are positioned at the same position in the vertical direction of the watercraft. More accurately, the regulator chamber Cre of the main air-fuel mixture supplying system Cm and an outlet end of the fuel supplying passage 62 of the auxiliary air-fuel mixture supplying system Cs are positioned substantially at the same position in the vertical direction of the watercraft. Thereby, when the main air-fuel mixture supplying system Cm and the auxiliary air-fuel mixture supplying system Cs have the common regulator chamber Cre as illustrated in this embodiment, a head pressure does not act on the fuel supplied to these air-fuel mixture supplying systems, and consequently, the air-fuel mixture can be stably supplied to the engine E from these air-fuel mixture supplying systems.

In this embodiment, since the auxiliary air-fuel mixture supplying system Cs and the main air-fuel mixture supplying system Cm are provided on the same side, that is, on the side of the intake port Ei of the engine E, the connecting passage 70 can be shortened. As a result of this, the response of the engine E to the supply of air-fuel mixture from the auxiliary air-fuel mixture supplying system Cs can be improved.

A branch tube Cb having three air-fuel mixture supplying ports Co is connected to the end of the air-fuel mixture supply of the auxiliary air-fuel mixture supplying system Cs. The air-fuel mixture supplying ports Co are respectively connected to the main air-fuel mixture supplying passage Q1 of each cylinder of the engine E through the connecting passages 70 having equal length. Therefore, responses to the supply of the air-fuel mixture to the respective cylinders become equal.

The personal watercraft of this embodiment includes the above-identified configuration and function. Since the other configuration and function are identical to those of the third embodiment, the corresponding parts are referenced to by the same reference numerals and the detailed description thereof is omitted.

Seventh Embodiment

Figure 17:
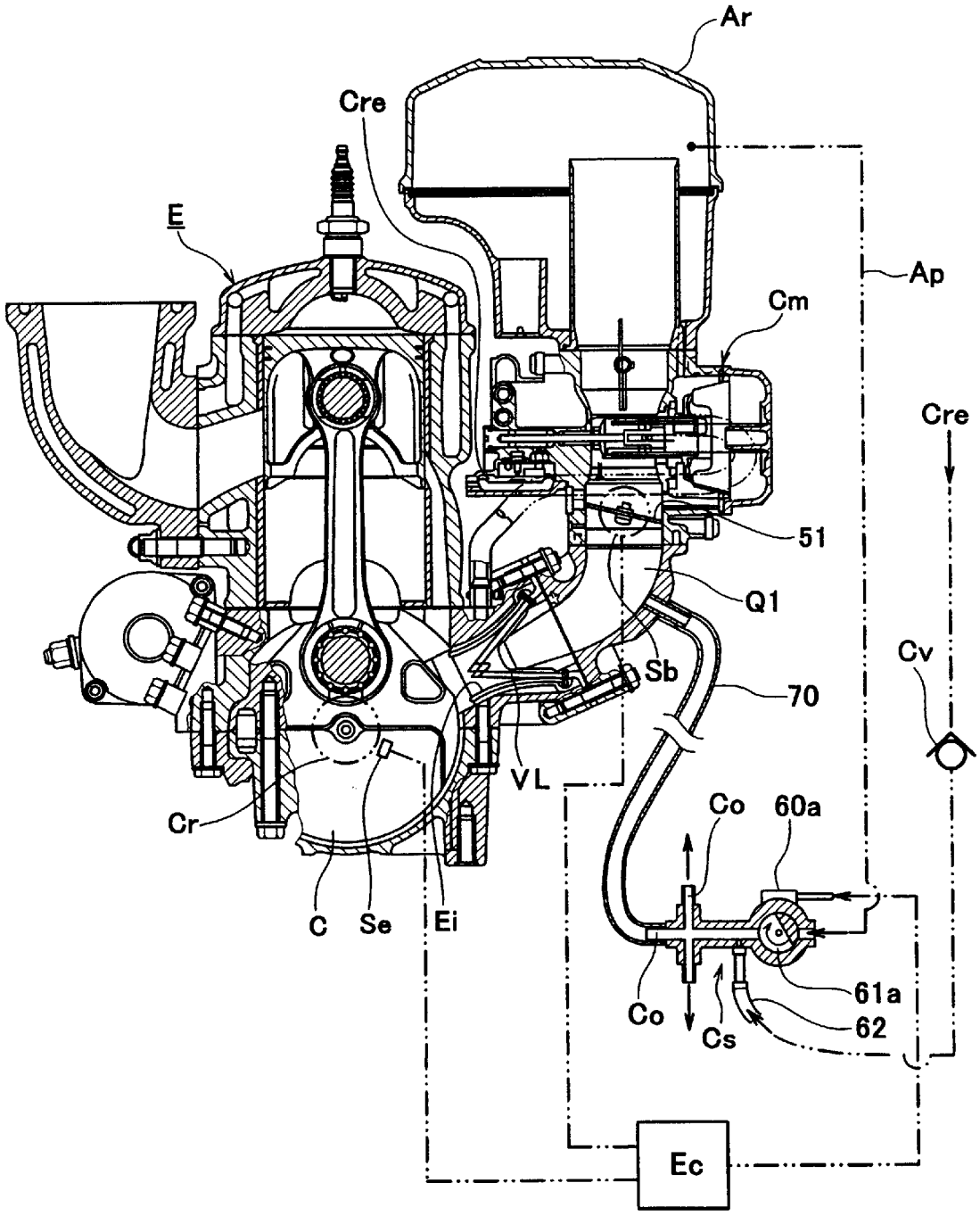
FIG. 17 is a view showing a configuration of a control system of a personal watercraft according to a seventh embodiment based on the relationship with the engine.

The slide-type auxiliary valve 61 may be replaced by a rotary-type auxiliary valve 61*a* of FIG. 17 similarly to the fourth embodiment.

The personal watercraft of this seventh embodiment includes the above-identified configuration and function. Since the other configuration and function are identical to those of the fourth embodiment, the corresponding parts are referenced to by the same reference numerals and the detailed description thereof is omitted.

In each of the above-described embodiments, the throttle valve of the main air-fuel mixture supplying system Cm is not limited to the above-described butterfly-type valve, and a valve of arbitrary configuration may be employed, similarly to the auxiliary air-fuel mixture supplying system Cs.

In each of the embodiments, the forward movement of the watercraft has been described. When the rider operates the reverse switching lever Lr to cause the watercraft to move rearward, the same operation may be performed.

Figure 18:
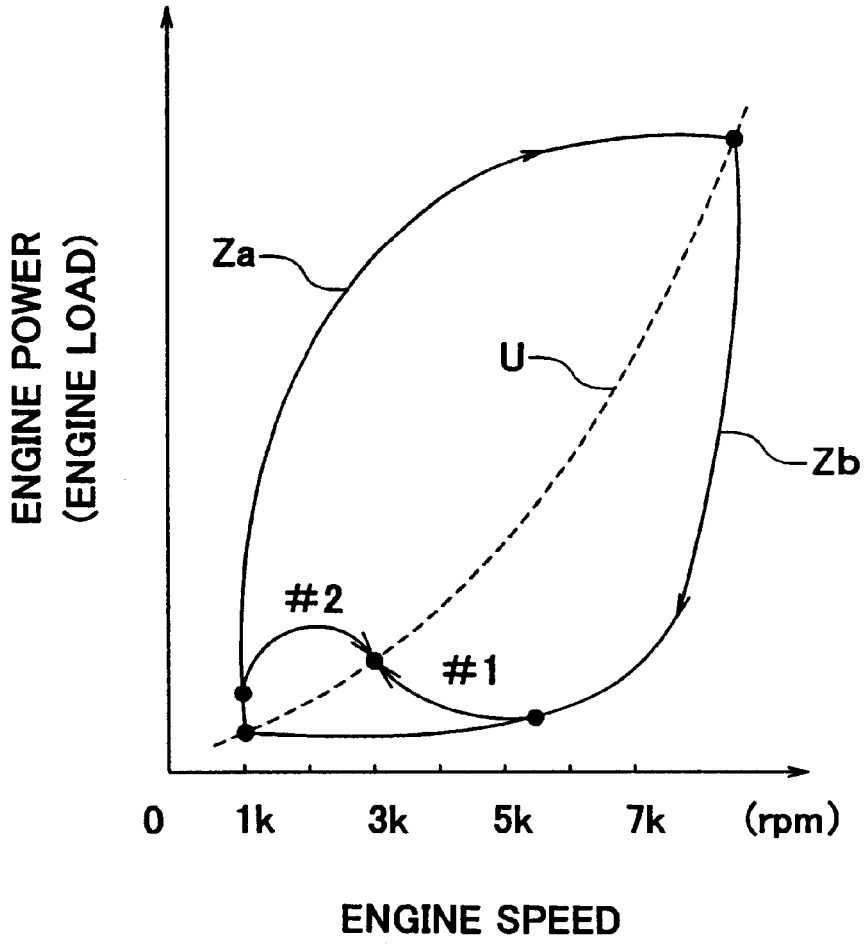
FIG. 18 is a graph showing a hysteresis characteristic between an engine speed and an engine power (engine load), and a propulsion force characteristic of a water jet pump associated with the hysteresis characteristic.

FIG. 18 is a graph showing a hysteresis characteristic between the engine speed and the engine power (engine load), with the engine speed on a horizontal axis (1 k represents "1000") and the engine power on a vertical axis. A dashed line U indicates the engine load to drive the water jet pump P. For example, when the rider performs throttle-open operation without the steering assist mode control, the engine speed is increased with a degree at which the throttle is opened and the engine power is increased along an ascending line Za. On the other hand, when the rider performs the throttle-close operation in the cruising state, the engine speed is decreased with a degree at which the throttle is closed and the engine power is decreased along a descending line Zb.

Here, it is assumed that the predetermined value at which the steering assist mode control starts is set to 5500 rpm. When the rider performs throttle-close operation while the watercraft is cruising at the engine speed larger than 5500 rpm, the engine speed is decreased in a relatively short time. If the steering assist mode is started when the engine speed is decreased to 5500 rpm, the engine speed is maintained at 3000 rpm (engine speed set under the steering assist mode control) or more upon the steering assist mode control being executed. Accordingly, the propulsion force sufficient to turn the watercraft is obtained (pattern # 1). In this case, when the steering assist mode control starts, the watercraft is cruising at the engine speed larger than 3000 rpm, and therefore, the engine speed is decreased but the engine power is increased up to 3000 rpm on the dashed line U.

In the pattern # 1, the engine speed is apparently decreased after the steering assist mode control is executed. In actuality, however, the engine speed to be decreased in a very short time is maintained at a level (3000 rpm on the dashed line U) at which a propulsion force sufficient to turn the watercraft is obtained. Depending on the controlled speed, there is a possibility that the engine speed becomes temporarily smaller than 3000 rpm.

When the steering assist mode control is executed in a state in which the engine speed is smaller than 3000 rpm, the engine speed is increased up to 3000 rpm on the dashed line U. Accordingly, the propulsion force sufficient to turn the watercraft is obtained (pattern #2). In this case, when the steering assist mode control starts, the degree at which the engine power is increased is relatively larger than that of the dashed line U, but the engine power is gradually decreased with an increase in the speed of the watercraft.

When the steering assist mode control is started in the state in which the engine speed is 5500 rpm or less on the descending line Zb of this embodiment, the engine speed can be decreased to 3000 rpm on the dashed line U by substantially changing the throttle position of the auxiliary air-fuel mixture supplying system Cs without actually changing the throttle position of the main air-fuel mixture supplying system Cr.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within meters and bounds of the claims, or equivalence of such meters and bounds thereof are therefore intended to be embodied by the claims.

What is claimed is:

1. A jet-propulsion watercraft comprising:

a water jet pump including an outlet port and a steering nozzle, said water jet pump pressurizing and accelerating sucked water and ejecting the water from the outlet port to propel the watercraft as a reaction of the ejecting water;

an engine for driving the water jet pump, the engine being provided with a throttle valve;

a steering operation means operating in association with the steering nozzle of the water jet pump, the steering operation means including a rotational shaft having a steering handle provided thereon;

a throttle lever provided on the steering handle to be operated by an operator for opening and closing the throttle valve;

a first connecting member for connecting the throttle lever and the throttle valve, wherein the first connecting member comprises a cable having a first end and a second end, wherein the first end is connected to the throttle lever, and the second end is connected to the throttle valve, whereby operation of the throttle lever causes the throttle lever to pull the first connecting member to open the throttle valve; and a second connecting member provided between the steering operation means and the throttle lever, wherein the throttle valve is opened through the first connecting member and the second connecting member according to a steering operation of the steering operation means.

2. The jet-propulsion watercraft according to claim 1, wherein the rotational shaft has a radially protruded portion, and wherein the second connecting member comprises a push-pull cable having a first end and a second end, wherein the first end is connected to the radially protruded portion so as to rotate with the steering handle, and the second end is located so as to be opposed to the throttle lever, wherein the protruded portion pushes the first end of the second connecting member toward the throttle lever when the rotational shaft is rotated according to the steering operation, and the second end of the second connecting member comes in contact with the throttle lever to push the throttle lever to cause the throttle valve to be opened.

3. The jet-propulsion watercraft according to claim 2, wherein the second connecting member comprises a pair of push-pull cables having first ends and second ends that are respectively pushed and pulled toward opposite directions with respect to each other according to the rotation of the rotational shaft, and one of the second ends is advanced/retracted so as to operate the throttle lever to cause the throttle valve to be opened.

4. The jet-propulsion watercraft according to claim 2, wherein the steering operation means includes a support member provided on the steering handle, the throttle lever is rotatably supported on the support member, and wherein the second end of the second connecting member is supported by the support member therethrough movably in the length direction thereof so that the second end of the second connecting member is opposed to the throttle lever.

5. The jet-propulsion watercraft according to claim 2, wherein the second end of the second connecting member protrudes in accordance with the steering operation, and wherein the second end of the second connecting member does not come in contact with the throttle lever when the throttle lever is operated more than a predetermined amount, and the second end of the second connecting member comes in contact the throttle lever when the steering operation is exceeded a given amount and the throttle lever is operated within the predetermined amount.

6. The jet-propulsion watercraft according to claim 2, wherein the steering operation means includes a handle stopper provided in a moving area of the protruded portion in accordance with the rotation of the rotational shaft for restricting the movement of the rotational shaft by stopping the protruded portion in one of the rotational directions of the rotational shaft, and wherein the push-pull cable of the second connecting member includes a cable core and a cable covering tube for covering the cable core, and both ends of the cable core are exposed from the cable covering tube to be the first and second ends, and wherein the core portion that corresponds to the first end of the second connecting member is fixed to the protruded portion and the cable covering tube that corresponds to the first end of the second connecting member is fixed to the handle stopper.

7. A jet-propulsion watercraft comprising:

a water jet pump including an outlet port and a steering nozzle, said water jet pump pressurizing and accelerating sucked water and ejecting the water from the outlet port to propel the watercraft as a result of the ejecting water;

an engine for driving the water jet pump, the engine being provided with a throttle valve;

a steering operation means operating in association with the steering nozzle of the water jet pump, said steering operation means including a rotational shaft;

a throttle lever adapted to open/close the throttle valve;

a first connecting member for connecting the throttle lever to the throttle valve; and a second connecting member for connecting the steering operation means to the throttle lever so as to operate the throttle lever to cause the throttle valve to be opened according to a steering operation of the steering operation means, said second connecting member comprising a pair of push-pull cables having first ends and second ends that are respectively pushed and pulled toward opposite directions with respect to each other according to the rotation of the rotational shaft, and one of the second ends is advanced/retracted so as to operate the throttle lever to cause the throttle valve to be opened.

8. A jet-propulsion watercraft comprising:

a water jet pump including an outlet port and a steering nozzle, said water jet pump pressurizing and accelerating sucked water and ejecting the water from the outlet port to propel the watercraft as a reaction of the ejecting water;

an engine for driving the water jet pump;

a steering operation means operating in association with a steering nozzle of the water jet pump;

a first air-fuel mixture supplying system for supplying an air-fuel mixture to the engine through a first air-fuel mixture supplying passage, the first air-fuel mixture supplying system being provided with a first throttle valve;

a second air-fuel mixture supplying system for supplying an air-fuel mixture to the engine through a second air-fuel mixture supplying passage; and a throttle lever for performing an open/close operation of the first throttle valve, wherein the second air-fuel mixture supplying system is adapted to increase the air-fuel mixture supplied to the engine from the second air-fuel mixture supplying system during the operation of the steering operation means, thereby increasing the engine speed.

9. The jet-propulsion watercraft according to claim 8, wherein the steering operation means includes a rotational shaft, and wherein the second air-fuel mixture supplying system is provided with a second throttle valve, the watercraft further comprising:

a first connecting member for connecting the throttle lever to the first throttle valve; and a second connecting member for connecting the steering operation means or the rotational shaft of the steering operation means to the second throttle valve to cause the second throttle valve to be opened according to the steering operation of the steering operation means.

10. The jet-propulsion watercraft according to claim 8, wherein the second air-fuel mixture supplying system is provided directly at a position in an air supplying passage to the first air-fuel mixture supplying system and in the first air-fuel mixture supplying passage.

11. The jet-propulsion watercraft according to claim 8, wherein the second air-fuel mixture supplying system is provided at a position in an air supplying passage to the first air-fuel mixture supplying system and the first air-fuel mixture supplying passage indirectly through a predetermined connecting passage.

12. The jet-propulsion watercraft according to claim 8, wherein the second air-fuel mixture supplying system is provided in a bypass passage of the first air-fuel mixture supplying passage that bypasses the first throttle valve.

13. The jet-propulsion watercraft according to claim 8, further comprising:

a steering position sensor for detecting a predetermined steering position of the steering operation means; and an electric control unit, wherein the electric control unit is adapted to increase the engine speed by increasing the air-fuel mixture being supplied to the engine from the second air-fuel mixture supplying system while the steering position sensor is detecting a predetermined steering position.

14. The jet-propulsion watercraft according to claim 13, wherein the electric control unit is adapted to increase the engine speed to increase a propulsion force of the watercraft.

15. The jet-propulsion watercraft according to claim 13, wherein the second air-fuel mixture supplying system is provided with a second throttle valve, and wherein, the electric control unit is adapted to increase the engine speed by opening the second throttle valve.

16. The jet-propulsion watercraft according to claim 15, further comprising:

a solenoid for opening the second throttle valve, and wherein the electric control unit is adapted to open the second throttle valve by making the solenoid conductive.

17. The jet-propulsion watercraft according to claim 13, wherein the steering position sensor is a proximity switch provided to a rotational shaft of the steering operation means.

18. The jet-propulsion watercraft according to claim 13, further comprising:

a throttle-close operation detecting means for detecting a close operation of the first throttle valve, and wherein the electric control unit is adapted to increase the engine speed by increasing the air-fuel mixture being supplied to the engine from the second air-fuel mixture supplying system while the steering position sensor is detecting the predetermined steering position and the throttle-close operation detecting means is detecting the close operation of the first throttle valve.

19. The jet-propulsion watercraft according to claim 18, wherein the throttle-close operation detecting means is a throttle position sensor for detecting a position of the first throttle valve.

20. The jet-propulsion watercraft according to claim 18, wherein the throttle-close operation detecting means is an engine speed sensor for detecting the engine speed.

21. The jet-propulsion watercraft according to claim 8, wherein the second air-fuel mixture supplying system is provided on the side of the first air-fuel mixture supplying system with respect to the engine.

22. The jet-propulsion watercraft according to claim 8, further comprising:

a check valve provided in a fuel supplying passage for supplying fuel to the second air-fuel mixture supplying system from a fuel supply source, for preventing back flow of the fuel.

23. The jet-propulsion watercraft according to claim 8, wherein the second air-fuel mixture supplying system includes an air supplying passage, and is provided with a liquid entry prevention means provided at a supply source side end of the air supplying passage, for preventing liquid from being mixed into a supply air.

24. The jet-propulsion watercraft according to claim 23, wherein the liquid entry prevention means is an air-intake box provided in the first air-fuel mixture supplying system.

25. The jet-propulsion watercraft according to claim 8, wherein the first air-fuel mixture supplying system and the second air-fuel mixture supplying system comprise a common fuel supply source.

26. The jet-propulsion watercraft according to claim 8, wherein the first air-fuel mixture supplying system and the second air-fuel mixture supplying system are located at substantially the same position in the vertical direction of the watercraft.

27. The jet-propulsion watercraft according to claim 8, wherein the second air-fuel mixture supplying system is mounted to a position of the watercraft that is within a vibration system independent of a vibration system of the engine.

28. The jet-propulsion watercraft according to claim 8, wherein the engine is a multiple-cylinder engine, and is configured to supply the air fuel mixture to the first air-fuel mixture supplying passage of the respective cylinders from the second air-fuel mixture supplying system through a plurality of branched connecting passages.

29. The jet-propulsion watercraft according to claim 28, wherein the branched connecting passages have substantially equal lengths.

30. A jet-propulsion watercraft comprising:

a water jet pump including an outlet port and a steering nozzle, said water jet pump pressurizing and accelerating sucked water and ejecting the water from the outlet port to propel the watercraft as a reaction to the ejecting water;

an engine for driving the water jet pump, the engine being provided with a throttle valve;

a steering operation means operating in association with the steering nozzle of the water jet pump, the steering operation means including a rotational shaft having a radially protruded portion and a steering handle provided thereon;

a throttle lever provided on the steering handle to be operated by an operator for opening and closing the throttle valve;

a first connecting member for connecting the throttle lever and the throttle valve, the first connecting member comprising a cable having a first end and a second end, wherein the first end is connected to the throttle lever, and the second end is connected to the throttle valve, whereby operation of the throttle lever causes the throttle lever to pull the first connecting member to open the throttle valve;

a pair of handle stoppers provided in a moving area of the protruded portion in accordance with the rotation of the rotational shaft for restricting the movement of the rotational shaft by stopping the protruded portion in both rotational directions of the rotational shaft; and a second connecting member provided between the steering operation means and the throttle lever so as to operate the throttle lever to cause the throttle valve to be opened according to a steering operation of the steering operation means, wherein the second connecting member comprises a push-pull cable having a cable core and a pair of cable covering tubes for covering the cable core, wherein an intermediate section and both ends of the cable core are exposed from the cable covering tube, the intermediate section of the cable core is located between the handle stoppers and supported by the protruded portion of the rotational shaft slidably in the rotational direction of the rotational shaft, opposing ends of the cable covering tubes at both ends of the intermediate section of the cable core are fixed to the handle stoppers, and both ends of the cable core are located so as to be opposed to the throttle lever, the cable core is provided with flanges fixed thereon between the handle stopper and the protruded portion of the rotational shaft, and wherein one of the flanges is pushed by the protruded portion so that the cable core is pushed toward the rotational direction of the rotational shaft, and the corresponding end of the cable core is advanced to push the throttle lever to cause the throttle valve to be opened.

31. The jet-propulsion watercraft according to claim 30, wherein the cable core is further provided with a compression spring between the handle stopper and the flange.

* * * * *

UNITED STATES PATENT AND TRADEMARK OFFICE

CERTIFICATE OF CORRECTION

PATENT NO. : 6,478,638 B1 
DATED : November 12, 2002
INVENTOR(S) : Yoshimoto Matsuda et al.

It is certified that error appears in the above-identified patent and that said Letters Patent is hereby corrected as shown below:

Column 18,
Line 7, please change “connecting member toward” to -- connecting members toward --.
Line 9, please change “connecting member comes” to -- connecting members comes --.

Signed and Sealed this

Eleventh Day of March, 2003

JAMES E. ROGAN
*Director of the United States Patent and Trademark Office*